US010597974B2

(12) United States Patent
Atkins et al.

(10) Patent No.: US 10,597,974 B2
(45) Date of Patent: Mar. 24, 2020

(54) DOWNHOLE VALVE APPARATUS

(71) Applicant: M-I DRILLING FLUIDS UK LTD, Aberdeen (GB)

(72) Inventors: James Edward Atkins, Aberdeen (GB); Jonathan Peter Buckland, Inverurie (GB); James Linklater, Buckie (GB)

(73) Assignee: M-I DRILLING FLUIDS UK LTD, Aberdeen (GB)

( * ) Notice: Subject to any disclaimer, the term of this patent is extended or adjusted under 35 U.S.C. 154(b) by 0 days.

(21) Appl. No.: 16/067,614

(22) PCT Filed: Dec. 29, 2016

(86) PCT No.: PCT/GB2016/054087
§ 371 (c)(1),
(2) Date: Jul. 1, 2018

(87) PCT Pub. No.: WO2017/115088
PCT Pub. Date: Jul. 6, 2017

(65) Prior Publication Data

US 2019/0003283 A1 Jan. 3, 2019

(30) Foreign Application Priority Data

Dec. 30, 2015 (GB) ..... 1523095.6
Dec. 30, 2015 (GB) ..... 1523097.2

(51) Int. Cl.
*E21B 34/10* (2006.01)
*E21B 34/14* (2006.01)
(Continued)

(52) U.S. Cl.
CPC ..... *E21B 34/10* (2013.01); *E21B 21/103* (2013.01); *E21B 34/14* (2013.01); *E21B 2034/007* (2013.01)

(58) Field of Classification Search
CPC ..... E21B 34/10; E21B 34/14; E21B 21/103; E21B 2034/007
See application file for complete search history.

(56) References Cited

U.S. PATENT DOCUMENTS 3,730,267 A * 5/1973 Scott ..... E21B 33/146 166/335
6,173,795 B1 1/2001 McGarian et al.
(Continued)

FOREIGN PATENT DOCUMENTS

GB 2545919 A 7/2017
GB 2545920 A 7/2017
WO 2001/90529 A1 11/2001

OTHER PUBLICATIONS

Examination Report for the equivalent UK patent application 1523097.2 dated Jul. 4, 2018.

(Continued)

*Primary Examiner* — Matthew R Buck
*Assistant Examiner* — Aaron L Lembo
(74) *Attorney, Agent, or Firm* — Jeffrey D. Frantz

(57) ABSTRACT

A valve assembly for use in a wellbore of an oil, gas or water well, having a valve seat to seat a valve closure member such as a ball, and a control member that is adapted to cycle the valve assembly between first and second configurations of the valve assembly when the ball is seated on the seat. The valve assembly may be adapted to return the valve assembly to the first configuration when the valve closure member is seated on the seat, and may repeatedly, continuously and/or sequentially cycle from first to second configurations and back to first configuration to open and close an outlet port while the same valve member is seated on the seat. The valve seat may comprise first and second seat members and retain the ball in a cleft between the first and second seat members.

20 Claims, 9 Drawing Sheets

(51) Int. Cl.
*E21B 21/10* (2006.01)
*E21B 34/00* (2006.01)

(56) References Cited

U.S. PATENT DOCUMENTS

| | | | | |
|---|---|---|---|---|
| 7,416,029 | B2 * | 8/2008 | Telfer | E21B 21/103 166/318 |
| 7,681,650 | B2 | 3/2010 | Telfer et al. | |
| 9,574,414 | B2 * | 2/2017 | Arabsky | E21B 34/14 |
| 2008/0169108 | A1 | 7/2008 | Mondelli et al. | |
| 2014/0099447 | A1 | 4/2014 | Kim et al. | |

OTHER PUBLICATIONS

Intemational Preliminary Report on Patentability for the equivalent International patent application PCT/GB2016/054087 dated Jul. 12, 2018.
International Search Report and Written Opinion for the equivalent International patent application PCT/UB2016/054087 dated May 16, 2017.
Examination Report for the equivalent Australian patent application 2016383123 dated Feb. 21, 2019.
Examination Report for the equivalent Canadian patent application 3009888 dated Apr. 3, 2019.

* cited by examiner

DOWNHOLE VALVE APPARATUS

The present application relates generally to an apparatus and method, and particularly to a valve assembly and to a method of controlling fluid flow in an oil or gas or water well.

BACKGROUND

Downhole drilling operations in an oil or gas well normally involve the circulation of fluid, to wash cuttings away from the drill bit at the bottom of the hole, and to return the cuttings to the surface. US 2014/0099447 discloses a valve used in such operations which is useful for understanding the present method and apparatus. Valves are normally operated by landing a plug, for example a ball, on a seat (e.g. a ball seat), or shearing a pin, to open a radial outlet port to an annulus. Fluid can circulate through the open outlet port to the annulus outside the valve, which can be helpful in clearing the annulus of cuttings or other debris. The plug is generally expelled from the valve seat either under the action of fluid pressure alone, or in tandem with a smaller plug that is dropped after the first plug, and which has smaller dimensions, thus allowing the second plug to pass freely through the seat.

U.S. Pat. No. 7,681,650 and WO 01/90529 are also useful for understanding the present apparatus and method.

SUMMARY

The present application discloses a valve assembly for use in a wellbore of an oil, gas or water well, the valve assembly having a bore with an axis, the assembly having a valve seat adapted to seat a valve closure member, the assembly comprising an outlet port and a control sleeve adapted to cycle the valve assembly between a first configuration and a second configuration of the valve assembly, wherein in the first configuration of the valve assembly, the control sleeve is configured to obturate the outlet port and to restrict fluid communication between the bore and the outlet port, and wherein in the second configuration the control sleeve is configured to allow at least partial fluid communication between the bore and the outlet port; and wherein the valve assembly is repeatedly cyclable between the first and second configurations of the valve assembly, while the valve closure member is seated on the valve seat, by changes in fluid pressure acting on the seated valve closure member.

The valve assembly is adapted to return the valve assembly to the first configuration when the valve closure member is seated on the seat.

The control sleeve is adapted to repeatedly, optionally continuously and/or sequentially, cycle the valve assembly from first to second configurations and back to first configuration etc. while the valve member is seated on the seat.

Optionally the valve assembly has a valve assembly housing, the housing optionally having a bore with an axis. Optionally the housing forms part of the wellbore conduit and is optionally connected by threaded connections to the wellbore conduit, optionally at each of the uphole and downhole ends. Optionally the axis of the valve assembly housing is coaxial with the axis of the wellbore. Optionally the axis of the valve assembly is coaxial with the axis of the housing. The bore optionally allows passage of fluid through the valve assembly. The valve closure member optionally moves at least partially through the valve seat when subjected to fluid pressure differentials across the valve seat.

The valve assembly is optionally biased into the first configuration and is adapted to be switched into the second configuration by a change (optionally a reversal) in fluid pressure on the seated valve closure member. The valve assembly is optionally adapted to be cycled sequentially and repeatedly between the first and second configurations of the valve assembly while the valve closure member is seated on the seat by sequential changes (for example increases followed by decreases, or decreases followed by increases) in fluid pressure acting on the seated valve closure member.

The valve assembly has at least one outlet port adapted to be actuated between closed and open configurations (which can correspond to first and second configurations of the valve assembly) to restrict and permit fluid communication between the bore and an external surface of the valve assembly, for example, an annulus between the external surface of the assembly and the inner surface of a wellbore conduit of an oil or gas well. Optionally the outlet port extends radially through a wall, optionally through the wall of the valve assembly housing.

The outlet port is obturated by the control sleeve, which moves axially relative to the outlet port. Optionally the outlet port remains static with respect to the bore and the control sleeve is a sliding sleeve which slides axially relative to the outlet port to open and close it. Optionally the control sleeve has an aperture which is adapted to move at least partially within the bore to control fluid communication with the outlet port. Thus the movement of the control sleeve relative to the outlet port is optionally adapted to increase and/or decrease the degree of alignment of the outlet with the aperture on the control sleeve as the control sleeve moves relative to the outlet port. The degree of alignment between the aperture and the outlet can vary such that in some configurations, the outlet can be partially open (i.e. partially aligned with the aperture on the control sleeve) and in others it can be fully open (fully aligned with the aperture on the control sleeve). Optionally the control sleeve has seals (optionally annular seals above and below the aperture on the control sleeve) which seal off the outlet port from the bore when the control sleeve and outlet port are in the closed configuration. Optionally, the valve seat is provided in the control sleeve.

Optionally the valve assembly comprises an outlet sleeve, which can be fixed relative to the outlet port, and which can include an aperture in fluid communication (and optionally aligned) with an inner end of the outlet port, whereby fluid passing through the outlet sleeve passes through the aperture therein, and thereafter through the outlet port, optionally flowing into the annulus outside the housing. The outlet sleeve is optionally fixed within the bore of the housing in a replaceable manner, and can be removed and replaced in the event of erosion of the aperture in the outlet sleeve. The outlet port is optionally sealed, optionally by resilient seals compressed between the outlet sleeve and outlet port. Optionally, the control sleeve is received within the bore of the outlet sleeve, and slides axially relative to the static outlet sleeve, which remains stationary relative to the outlet port.

Optionally more than one outlet port can be provided in the housing, and more than one corresponding aperture can be provided in the outlet sleeve and control sleeve.

Optionally the outlet sleeve is fixed in position by at least two fixing members. Optionally the fixing members are inserted radially inwards through the wall of the housing and into receiving holes in the outlet sleeve, thereby securing the outlet sleeve in position in the housing. Optionally the at least two fixing members are disposed on circumferentially opposing sides of the outlet sleeve. Optionally the fixing members are threaded. Optionally the outlet sleeve is restrained from both rotational and axial movement, optionally relative to the housing, and optionally relative to the other components of the valve assembly.

Optionally the first configuration of the valve assembly is a closed configuration. Optionally in the closed configuration, the outlet port through the valve assembly housing is closed off from the bore by the control sleeve, and all fluid flows through the central bore of the valve assembly, optionally unimpeded by a valve closure member. Optionally in the closed configuration fluid is prevented from flowing along the outer surface of the control sleeve, between the control sleeve and the outlet sleeve and into the radial ports by at least one circumferential seal, optionally more than one seal. Optionally the seals are annular seals. Optionally the seals are resilient seals, such as o-rings. Optionally the seals are metal-to-metal seals.

Optionally the indexing mechanism can cycle the valve assembly through intermediate configurations between the first and second configurations. The intermediate configurations can have open or closed bores, and open or closed outlet ports. Optionally in at least one intermediate configuration, the outlet port is closed, as is the bore. The intermediate configuration is optionally a reset configuration, in which the valve assembly can be cycled back to the first configuration with a closed outlet port and optionally with an open bore. The indexing mechanism can be adapted to hold the valve assembly in at least one intermediate configuration in the absence of pressure acting on the seated valve closure member. Optionally the biasing member can bias the control sleeve into the at least one intermediate configuration.

Optionally the valve assembly comprises a resilient device. Optionally the resilient device comprises a compression spring. Optionally the resilient device can be one of a coil spring; a Belleville spring; a wave spring, without excluding any other resilient device. Optionally the resilient device biases the valve assembly towards a closed (first) configuration. Optionally the resilient device circumferentially surrounds at least a portion of the control sleeve, and optionally urges it axially within the bore. Optionally the resilient device is axially restrained at its uphole end by the control sleeve. Optionally the resilient device is held in compression within the bore of the housing between an upwardly facing lower shoulder fixed in the bore of the housing at a downhole end of the resilient device and a shoulder or other portion of the control sleeve at the upper end of the resilient device. Optionally the resilient device can engage against a spring retainer at either end of the resilient device, which can optionally engage the lower shoulder and the control sleeve. The spring retainer optionally circumferentially surrounds a portion of the control sleeve. Optionally the spring retainer centralises the control sleeve within the bore, guiding its movement.

The assembly optionally incorporates an indexing mechanism adapted to control the change of configuration between the different configurations, comprising a track and pin arrangement which controls the movement of the control sleeve. The movement of the pin in the track optionally guides rotational and/or axial movement of the control sleeve relative to the outlet port. Optionally the pin can be static and the track can be in the outer surface of the control sleeve, which can slide axially relative to the pin, but other configurations are possible. The track is optionally an endless circumferential track, extending continuously around a circumference of the valve assembly, allowing continuous circumferential movement of the pin within the track. In the first configuration the pin is optionally in one axial end of the track, and the outlet port is in fluid communication with the bore, and in the second configuration, the pin is optionally in the other axial end of the track, and the outlet port is not in fluid communication with the bore.

Sequential cycles of increase and decrease in fluid pressure acting on the valve closure member are optionally able to cause the indexing mechanism to cycle the valve assembly continuously between first and second configurations. Continuous cycling is not required of course, and cycling between the first and second configurations in a repeated sequence is under the control of the pressure changes in many examples, and can be discontinued as desired by holding the pressure constant or within a range above the seated valve closure member.

The control sleeve can optionally comprise a single sleeve, or an assembly of sleeves connected together to move together as a control sleeve assembly. The different features of the control sleeve can be provided on one or more of the assembly of sleeves in the control sleeve assembly.

Optionally the seat comprises first and second seat members, which can optionally comprise mutually parallel rings extending circumferentially around the inner surface of the control sleeve, and spaced apart axially by a short distance, optionally less than the diameter of the valve closure member, so that both of the seat members can engage the valve closure member at the same time when the valve closure member is seated.

Optionally the seating of the valve closure member in the seat causes a build-up of fluid pressure uphole of the valve assembly. Optionally the pressure acts in a downhole direction on the obturated seat. Optionally, at a first threshold pressure, the fluid pressure differential across the seated valve closure member in one direction (i.e. downwards) overcomes the force of the resilient device urging the control sleeve in the opposite direction (i.e. upwards), and the control sleeve is urged by the fluid pressure differential axially downwards relative to the outlet port into the second (open) configuration, optionally compressing the resilient device, while retaining the valve closure member in the seat. Although the first seat member has deformed to allow passage of the ball through it at the first threshold pressure, the second seat member below it has a higher shear force, and resists deformation at the first threshold pressure, thereby preventing passage of the ball through the second seat member, and retaining it between the first and second seat members, and sealing the throat. Optionally the first seat member is disposed above the second seat member, and the second seat member has a higher elastic modulus than the first seat member. The second seat member can simply have a larger mass than the first and can be made of the same material, but in a stiffer structure less susceptible to deformation. Or the second seat member can be made from a stiffer material than the first. Thus at the first threshold pressure, the valve closure member is optionally retained in the seat and continues to obturate the bore of the valve assembly. The seat is optionally adapted to release the valve closure member in response to fluid pressure acting on the seated valve closure member at a second threshold pressure higher than the first threshold pressure.

Optionally, in the open configuration, the control sleeve seats against a shoulder formed in the bore of the housing to limit the axial travel. Optionally the shifting of the control sleeve relative to the outlet port(s) into the open configuration connects the outlet port(s) with the bore, (optionally through the alignment of the apertures in the control sleeve and the outlet sleeve with the outlet port) allowing fluid flow from the bore through the outlet port(s).

In one example, the control sleeve remains in the open configuration with the outlet port(s) in fluid communication with the bore subject to continued fluid pressure on the uphole side of the seated valve closure member. The force of the resilient device is optionally relatively weak, and the first threshold fluid pressure necessary to compress the spring is optionally below the second threshold fluid pressure necessary to deform the seat members and drive the seated valve closure member through the seat. Hence, at the first threshold pressure, the bore is obturated by the valve closure member, which remains in the seat when the valve is in the open configuration. Optionally the same valve closure member remains in the seat when the valve is in the first (closed) and second (open) configurations, and optionally is only released from the seat by forcing the valve closure member through the seat to return the valve to the first (closed) configuration with the bore of the valve open and the outlet port closed. Thus the apparatus can be opened, closed and reset back to the initial configuration all with a single valve closure member.

In one example, the outlet sleeve of the valve assembly comprises a leading edge at its uphole facing end. Optionally this leading edge is formed as a circumferential chamfered shoulder extending radially inwards into the bore. The shoulder optionally has a maximum diameter at its uphole end, and optionally narrows towards its downhole end, optionally to at least the same internal diameter as the bore of the control sleeve, such that the leading edge forms a funnel, having a throat that narrows to a diameter at its downhole end that is at least as narrow as the inner diameter of the bore of the control sleeve.

One effect of the leading edge is to reduce the thrust acting on the moving part of the valve (i.e. the control sleeve) in the downhole direction. The restriction in the inner diameter of the chamfered shoulder acts to reduce the drag forces experienced by the downhole portion of the valve assembly. Pressure experienced by the uphole face of the valve assembly is optionally correspondingly reduced in this arrangement relative to the pressure experienced by the assembly when a leading edge is not formed in the fixed sleeve. Thus the arrangement is less sensitive to accidental actuation without a valve closure member being seated in the bore.

The leading edge increases the velocity of the fluid and correspondingly decreases the fluid pressure, in accordance with Bernoulli's principle.

The valve seat is optionally resilient.

The first seat member is optionally adapted to seat the at least one valve closure member in a first configuration, and is adapted to resiliently deform from the first configuration to a second configuration to allow passage of the at least one valve closure member past the first seat member. The second seat member is optionally adapted to seat the at least one valve closure member in a first configuration, and is adapted to resiliently deform from the first configuration to a second configuration to allow passage of the at least one valve closure member past the second seat member. The first and second seat members are optionally axially spaced from one another at an axial distance, and the seat is optionally adapted to retain the at least one valve closure member between the first and second seat members. The first and second seat members are optionally adapted to engage the valve closure member at the same time, optionally on opposite sides of the valve closure member. Optionally the resilient action of the valve seat members urging the valve closure member from opposite axial directions resists movement of the valve closure member when engaged with the first and second seat members, and optionally keeps the valve closure member engaged with the seat, even in deviated or horizontal wellbores. The first and second seat members are optionally adapted to simultaneously urge the valve closure member in opposite axial directions from opposite axial ends of the valve closure member when the valve closure member is retained between the first and second seat members.

Optionally seating of the valve closure member on one or both of the first and second seat members closes the bore and prevents axial flow of fluid through the bore past the valve closure member on the seat member. Optionally each seat member circumferentially surrounds a portion of the valve closure member during deformation of the seat member, optionally maintaining a fluid-tight seal denying fluid passage between the seat members and the valve closure member when the valve closure member is seated, and optionally during the deformation of each seat member. Optionally each seat member is annular, having an inner diameter and an outer diameter which are optionally circular. Optionally the valve closure member moves through the annular seat members during deformation.

Optionally the valve assembly has a closure member catcher device adapted to catch and retain valve closure members that have passed through the seat members.

The first and second seat members are optionally adapted to deform resiliently away from one another in opposite axial directions when the valve closure member is retained between them, and the first and second seat members are optionally adapted to press on the valve closure member from opposite axial directions to resist movement of the valve closure member relative to the seat when said valve closure member is retained between the first and second seat members. The resilience of the seat members is optionally adapted to maintain sealing engagement of the valve closure member against the seat when the valve closure member is retained between the first and second seat members. An inner radial dimension of each seat member in the first configuration is optionally smaller than the maximal radial dimension of the valve closure member. Optionally in each seat member, the first configuration is the resting configuration in the absence of any forces applied to the seat member. Each seat member optionally maintains a consistent outer radial dimension in both of the first and second configurations. The inner radial dimension of each seat member optionally expands during deformation and axial passage of the valve closure member through the seat member, such that the radial thickness and optionally the volume of the seat member (and optionally the seat) reduces transiently during deformation. The inner diameter and radial thickness (and optionally the volume) of the first and second seat members (and the seat as a whole) optionally recover resiliently to the first configuration after axial passage of the valve closure member through the seat. The first and second seat members optionally extend radially inward from the inner surface of the bore. Optionally each seat member (and the seat) remains in a static axial position within the bore during deformation of the seat member. Optionally the deformation of the seat member is an elastic deformation within the elastic limits of the seat member, which resiliently returns to its first configuration with its original inner and outer diameter after passage of the valve closure member through the seat member.

Optionally each of the first and second seat members form a ring having a hemispherical cross-sectional profile, for example a convex annular bulge extending radially inwards into the bore on an inner surface of the bore. Each seat member optionally has an upper surface and a lower surface, wherein the upper and lower surfaces of the first and second seat members extend from the inner surface of the seat along an arcuate profile having a radius, and wherein each of the upper and lower surfaces have an apex at the axial midpoint of each seat member. The apex comprises the narrowest part of a throat of the bore through the seat member. The seat members optionally meet at a cleft which has a wider radial diameter than the throat of the bore, so that the first and second seat members expand radially inwards into the bore from the wider cleft. The radius of the arcuate profile of the first and second seat members is optionally constant, and the radius of the arcuate profile of one of the first and second seat members (usually the upper or first member, engaged first by the valve closure member) is less than the radius of the other seat member (usually the lower or second seat member engaged subsequently by the valve closure member). Optionally the upper and lower surfaces of the first and second seat members terminate in angles that are generally larger than 90 degrees with respect to the axis of the bore.

The valve seat and the seat members (and optionally the seat as a whole) are optionally integrally formed from the same resilient material.

The present application also discloses a method of controlling fluid flow in a wellbore of an oil, gas, or water well, the method including flowing fluid through a valve assembly comprising: a bore with an axis, the bore being in fluid communication with the wellbore, a valve seat adapted to seat a valve closure member, an outlet port, and a control sleeve adapted to cycle the valve assembly between a first configuration and a second configuration to control fluid flow within the bore; wherein the method includes: obturating the outlet port and restricting fluid communication between the bore and the outlet port in the first configuration of the valve assembly, and allowing at least partial fluid communication between the bore and the outlet port in the second configuration; admitting a valve closure member into the valve assembly and seating the valve closure member on the seat; and repeatedly and sequentially cycling the valve assembly between the first configuration and the second configuration of the valve assembly, when the valve closure member is seated on the seat, by sequentially increasing and decreasing the pressure acting on the seated valve closure member.

The various optional features of the valve assembly as defined above can be used with the method.

The present application also discloses a valve assembly for use in a wellbore of an oil, gas or water well, the valve assembly having a bore with an axis, the assembly having a valve seat adapted to seat a valve closure member, and a control member adapted to cycle the valve assembly between first and second configurations of the valve assembly, and wherein the valve assembly is repeatedly cyclable between the first and second configurations of the valve assembly while the valve closure member is seated on the seat by changes in fluid pressure above the seated valve closure member.

The present application also discloses a method of controlling fluid flow in a wellbore of an oil, gas, or water well, the method including flowing fluid through a valve assembly comprising: a bore with an axis, the bore being in fluid communication with the wellbore, a valve seat adapted to seat a valve closure member, and a control member adapted to cycle the valve assembly between first and second configurations to control fluid flow within the bore; wherein the method includes: admitting a valve closure member into the valve assembly and seating the valve closure member on the seat; and repeatedly and sequentially cycling the valve assembly between first and second configurations of the valve assembly when the valve closure member is seated on the seat by sequentially increasing and decreasing the pressure above the seated valve closure member.

The present application also discloses a valve assembly for use in a wellbore of an oil, gas or water well, the valve assembly having a bore with an axis, the assembly having a valve seat adapted to be sealed by at least one valve closure member, wherein the valve seat comprises a first seat member adapted to seat the at least one valve closure member in a first configuration of the first seat member, wherein the first seat member is adapted to resiliently deform from the first configuration to a second configuration of the first seat member to allow passage of the at least one valve closure member past the first seat member at a first threshold pressure, and a second seat member adapted to seat the at least one valve closure member in a first configuration of the second seat member, wherein the second seat member is adapted to resiliently deform from the first configuration to a second configuration of the second seat member to allow passage of the at least one valve closure member past the second seat member at a second threshold pressure, wherein said second threshold pressure is higher than the first threshold pressure, wherein the first and second seat members are axially spaced from one another on the seat by a cleft, and wherein the seat is adapted to retain the at least one valve closure member in the cleft between the first and second seat members.

The bore optionally allows passage of fluid through the valve assembly. The valve closure member optionally moves through the valve seat when subjected to fluid pressure differentials across the valve seat.

Optionally the seat members simultaneously urge the valve closure member in opposite axial directions from opposite axial ends of the valve closure member when the valve closure member is retained in the cleft between the seat members. Optionally the first and second seat members are adapted to seat against the valve closure member at the same time, optionally on opposite sides of the valve closure member. Optionally the resilient action of the valve seat members urging the valve closure member from opposite axial directions resists movement of the valve closure member when engaged with the first and second seat members, and optionally keeps the valve closure member engaged with the seat, even in deviated or horizontal wellbores.

Optionally seating of the valve closure member on one or both of the first and second seat members closes the bore and prevents axial flow of fluid through the bore past the valve closure member on the seat member. Optionally each seat member circumferentially surrounds a portion of the valve closure member during deformation of the seat member, optionally maintaining a fluid-tight seal denying fluid passage between the seat members and the valve closure member when the valve closure member is seated, and optionally during the deformation of each seat member. Optionally each seat member is annular, having an inner diameter and an outer diameter which are optionally circular. Optionally the valve closure member moves through the annular seat members during deformation.

Optionally the valve assembly has a closure member catcher device adapted to catch and retain valve closure members that have passed through the seat members.

An inner radial dimension of each seat member in the first configuration is optionally smaller than the maximal radial dimension of the valve closure member. Optionally in each seat member, the first configuration is the resting configuration in the absence of any forces applied to the seat member. Optionally the inner diameter of each seat member in the second configuration is larger than the inner diameter of the seat member in the first configuration.

The first and second seat members are optionally adapted to deform resiliently away from one another in opposite axial directions when the valve closure member is retained in the cleft between them, and the first and second seat members are optionally adapted to press on the valve closure member from opposite axial directions to resist movement of the valve closure member relative to the seat when said valve closure member is retained in the cleft between the first and second seat members. The resilience of the seat members is optionally adapted to maintain sealing engagement of the valve closure member against the seat when the valve closure member is retained in the cleft between the first and second seat members.

Each seat member optionally maintains a consistent outer radial dimension in both of the first and second configurations, and during deformation. Optionally each seat member (and optionally the seat as a whole) is formed from a resilient material such that the inner radial dimension of each seat member optionally expands, optionally circumferentially during deformation and axial passage of the valve closure member through the seat member, such that the radial thickness and optionally the volume of the seat member (and optionally the seat) reduces transiently during deformation. The inner diameter and radial thickness (and optionally the volume) of the first and second seat members (and the seat as a whole) optionally recover resiliently to the first configuration after axial passage of the valve closure member through the seat. The first and second seat members optionally extend radially inward from the inner surface of the bore. Optionally each seat member (and the seat) remains in a static axial position within the bore during deformation of the seat member.

Optionally the deformation of the seat member is an elastic deformation within the elastic limits of the seat member, which resiliently returns to its first configuration with its original inner and outer diameter after passage of the valve closure member through the seat member. Optionally the first seat member is disposed above the second seat member, and the second seat member has a higher elastic modulus than the first seat member. The second seat member can simply have a larger mass than the first and can be made of the same material, but in a stiffer structure less susceptible to deformation. Alternatively the second seat member can be made from a stiffer material than the first.

Optionally each of the first and second seat members extends radially inward from the inner surface of the bore. Each of the first and second seat members optionally has an upper surface and a lower surface. Each of the first and second seat members can optionally form a ring having a hemispherical profile, for example a convex annular bulge extending radially inwards into the bore on an inner surface of the bore. Optionally the upper surface and lower surfaces of the first and second seat members extend from the inner surface of the seat along an arcuate profile having a radius. Optionally the upper and lower surfaces of the first and second seat members meet in an apex, optionally at approximately the axial midpoint of each seat member. The apex can optionally comprise the narrowest part of a throat of the bore through the seat member. Optionally the apex of the first seat member is axially spaced from the apex of the second seat member, The seat members optionally meet at a cleft which has a wider radial diameter than the throat of the bore, so that the first and second seat members expand radially inwards into the bore from the wider cleft. Optionally the first seat member deforms such that the apex of the first seat member reduces in height (i.e. the inner diameter of the first seat member increases), optionally as the valve closure member passes through the throat of the bore formed by the first seat member. Optionally the valve closure member is then retained between the first and second seat members, optionally between the apex of the first seat member and the apex of the first member, optionally within the cleft. Optionally the radius of the first and second seat members is constant. Optionally the radius of one is different from the other. Optionally the radius of the first seat member (optionally upstream from the second seat member) is smaller than the radius of the second seat member. Optionally the upper and lower surfaces of the first and second seat members terminate in angles that are generally larger than 90 degrees with respect to the axis of the bore.

Optionally the valve seat and the seat members are integrally formed from the same resilient material.

The assembly optionally has at least one outlet port adapted to be actuated between open and closed configurations to permit and restrict fluid communication between the bore and an external surface of the valve assembly, for example, an annulus between the external surface of the assembly and the inner surface of a wellbore conduit of an oil or gas well. Optionally the outlet port extends radially through a wall, optionally through the wall of the valve assembly housing. Optionally the outlet port is obturated by a control sleeve which moves axially relative to the outlet port. Optionally the outlet port can slide axially within the bore, but in certain embodiments the outlet port remains static with respect to the bore and the control sleeve is a sliding sleeve which slides axially relative to the outlet port to open and close it. Optionally the control sleeve has an aperture which is adapted to move at least partially within the bore to control fluid communication with the outlet port. Thus the movement of the control sleeve relative to the outlet port is adapted to increase and/or decrease the degree of alignment of the outlet with the aperture on the control sleeve as the control sleeve moves relative to the outlet port. The degree of alignment between the aperture and the outlet can vary such that in some configurations, the outlet can be partially open (i.e. partially aligned with the aperture on the control sleeve) and in others it can be fully open (fully aligned with the aperture on the control sleeve). Optionally the control sleeve has seals (optionally annular seals above and below the aperture on the control sleeve) which seal off the outlet port from the bore when the control sleeve and outlet port are in the closed configuration. Optionally, the valve seat is provided in the control member, i.e. on the control sleeve.

Optionally the valve assembly comprises an outlet sleeve as previously described.

In one example, the control sleeve can be fixed rotationally in the bore such that it moves axially with respect to the outlet port, but does not rotate relative to the outlet port.

Optionally the valve closure member comprises a ball, but could also comprise a dart, a bar or any other plugging device which can travel by gravity or with fluid flow through the bore to engage the seat and obturate fluid flow through the bore. Optionally the valve closure member has a generally spherical structure, and/or optionally a generally consistent sealing diameter to engage with the seat. Optionally the valve closure member is non-deformable at the pressures used for the operation of the various examples, but could be deformable or at least partially comprised of a deformable material. Optionally there are two valve closure members. Optionally each valve closure member has the same sealing diameter. Optionally a first valve closure member has a larger diameter than a second valve closure member. Optionally the second valve closure member has an outer diameter adapted to pass through the seat members without seating the second valve closure member in the valve.

Optionally the profile of the first seat member comprises an arc, having a radius. Optionally the profile of the second seat member comprises an arc, having a radius. Optionally the first seat member is formed in an arc having a smaller radius than the second seat member. Optionally the second seat member is formed in an arc having a smaller radius than the first seat member. Optionally both seat members comprise arcs with the same radius.

Optionally at least one seat member, optionally the second seat member, and optionally both seat members, form a bore of optionally smaller diameter than the diameter of at least one valve closure member.

Optionally both of the seat members extend radially inwards from the inner surface of the control member, creating a throat in the seat, which is narrower than both the bore of the control member, and the valve closure member. Optionally the valve closure member has a diameter no larger than the inner diameter of the control member, and although it is retained by the seat, can pass freely through the remainder of the valve assembly without restriction.

When the valve is to be closed, optionally closure of the radial ports is achieved by admitting (e.g. dropping) a second, third, or further valve closure member(s) into the bore, e.g. from surface. Optionally the travel of the further valve closure member is halted by the first valve closure member retained in the bore between the first and second seat members. The axial spacing between the seat members and the radial ports is optionally adapted for the dimensions of the valve closure members, such that when the further valve closure member engages with the valve closure member retained between the seat members, the further valve closure member seals off or substantially restricts the bore, advantageously at a location uphole of the radial outlet ports, optionally preventing any diversion of fluid flow through the radial outlet ports. Optionally, the choking of fluid flow in the bore leads to a build-up of fluid pressure to a second pressure threshold uphole of the further valve closure member. Optionally this fluid pressure can be further increased from the surface pumps as required. Optionally this increased fluid pressure to the second pressure threshold acts on the further valve closure member and urges it in a downhole direction. The further valve closure member optionally in turn presses down on the valve closure member retained between the seat members. Optionally this results in the downhole valve closure member retained between the seat members being forced through the second seat member, which optionally deforms into the second configuration as the valve closure member passes through it. Optionally, the further valve closure member has a smaller outer diameter than the inner diameter of the seat members, and hence can pass through the valve seat without seating. Optionally the valve closure members are then caught in the closure member catching device further downhole.

Optionally the expulsion of all the valve closure members relieves the pressure on the resilient device in the valve assembly and results in the valve assembly returning to its first, closed configuration, with fluid travelling axially through the bore rather than radially through the outlet ports.

The present application also discloses a method of diverting fluid flow in a wellbore of an oil, gas, or water well, the method including flowing fluid through a valve assembly comprising a bore with an axis, and a valve seat having first and second seat members, the bore being in fluid communication with the wellbore; admitting a valve closure member into the valve assembly; resiliently deforming the first seat member to allow passage of the at least one valve closure member past the first seat member at a first threshold pressure; seating the valve closure member on the valve seat in the valve assembly; and retaining the valve closure member seated on the seat in a cleft between the first seat member and the second seat member.

Optionally the closure of the bore of the valve assembly by the valve closure member actuates the valve assembly from a first configuration (optionally axial flow) to a second configuration (optionally radial flow of fluid through a radial outlet port in a side wall of the valve assembly.

Optionally the first and second seat members are axially spaced from one another at an axial distance adapted to retain the at least one valve closure member in the cleft between the first and second seat members.

Optionally the valve closure members are dropped down the wellbore, or can be released from above the seat from another location within the well. They fall under gravity or are carried by fluid flow towards the valve seat.

The various optional features of the valve assembly as defined above can be used with the method.

Examples of the present apparatus and method are particularly useful in highly deviated wells, as once seated the ball remains engaged in the seat and obturates the bore regardless of the orientation of the borehole, and regardless of the force of fluid pressure from uphole. Retention of the seal helps to avoid premature disengagement of a downhole tool, or and improves consistency of cleaning in the annulus in circulation examples.

The present application also discloses a valve assembly for use in a wellbore of an oil, gas or water well, the valve assembly having a bore with an axis, the assembly having a valve seat adapted to be sealed by at least one valve closure member, wherein the valve seat comprises a first seat member adapted to seat the at least one valve closure member in a first configuration, wherein the first seat member is adapted to resiliently deform from the first configuration to a second configuration to allow passage of the at least one valve closure member past the first seat member at a first threshold pressure, and a second seat member adapted to seat the at least one valve closure member in a first configuration, wherein the second seat member is adapted to resiliently deform from the first configuration to a second configuration to allow passage of the at least one valve closure member past the second seat member at a second threshold pressure, wherein said second threshold pressure is higher than the first threshold pressure, wherein the first and second seat members are axially spaced from one another at an axial distance, and wherein the seat is adapted to retain the at least one valve closure member between the first and second seat members.

The present application also discloses a method of diverting fluid flow in a wellbore of an oil, gas, or water well, the method including flowing fluid through a valve assembly comprising a bore with an axis, and a valve seat having first and second seat members, the bore being in fluid communication with the wellbore; admitting a valve closure member into the valve assembly; resiliently deforming the first seat member to allow passage of the at least one valve closure member past the first seat member at a first threshold pressure; seating the valve closure member on the valve seat in the valve assembly; and retaining the valve closure member seated on the seat between the first seat member and the second seat member.

The various aspects of the present apparatus and method can be practiced alone or in combination with one or more of the other aspects, as will be appreciated by those skilled in the relevant arts. The various aspects of the present apparatus and method can optionally be provided in combination with one or more of the optional features of the other aspects of the present apparatus and method. Also, optional features described in relation to one aspect can typically be combined alone or together with other features in different aspects of the present apparatus and method. Any subject matter described in this specification can be combined with any other subject matter in the specification to form a novel combination.

Various aspects of the present apparatus and method will now be described in detail with reference to the accompanying figures. Still other aspects, features, and advantages of the present apparatus and method are readily apparent from the entire description thereof, including the figures, which illustrates a number of exemplary aspects and implementations. The present apparatus and method is also capable of other and different examples and aspects, and its several details can be modified in various respects, all without departing from the scope of the present apparatus and method as defined by the claims. Accordingly, each example herein should be understood to have broad application, and is meant to illustrate one possible way of carrying out the present apparatus and method, without intending to suggest that the scope of this disclosure, including the claims, is limited to that example. Furthermore, the terminology and phraseology used herein is solely used for descriptive purposes and should not be construed as limiting in scope. Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present apparatus and method. It is not suggested or represented that any or all of these matters formed part of the prior art base or were common general knowledge in the field relevant to the present apparatus and method.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the present apparatus and method which are present in certain examples but which can be omitted in others without departing from the scope of the present disclosure.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described to refer to the orientation of features shown in the drawings, and are not to be interpreted as limiting the present apparatus and method to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

DETAILED DESCRIPTION

Figure 1:
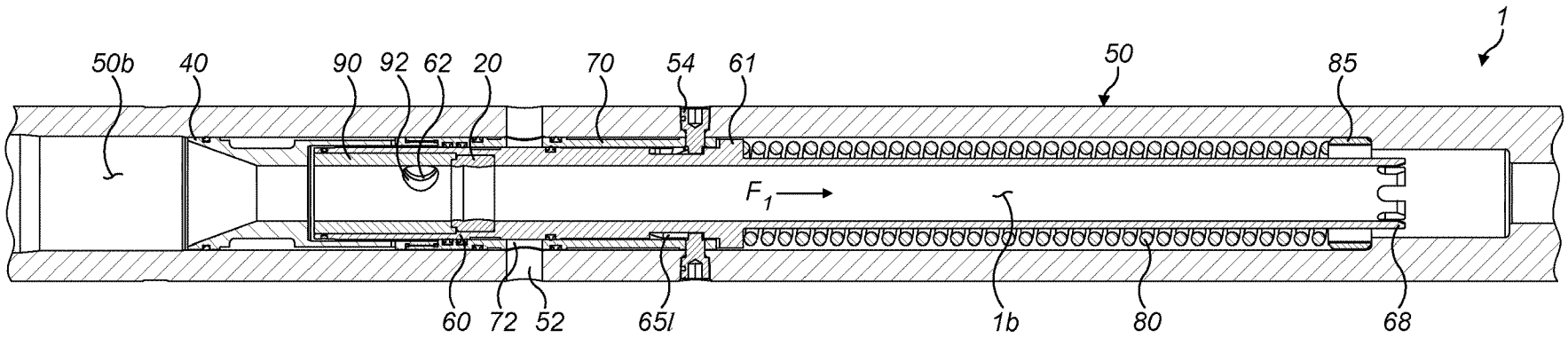
FIG. 1 shows a cutaway view of the valve assembly in a first (outlet port closed) configuration with no valve closure member seated.

Referring to the drawings, which show an example of a valve assembly 1 for use in a wellbore of an oil, gas or water well, comprises a housing 50 which can be in the form of a tubular having box and pin connections or similar, and adapted to be connected into a string of tubulars, for example a drill string, having a drill bit at the lower end. The housing 50 has a bore **50*b* in fluid communication with the bore of the string, and the bore 50***b* houses a number of valve components optionally in the form of sleeves. In this example, the bore 50*b* has an outlet sleeve 70 and a control sleeve 60. The outlet sleeve 70 at least partly surrounds a portion of a control sleeve 60, which has a bore 1*b* with an axis that is generally co-axial with the bore 50*b* of the housing and the bore of the outlet sleeve 70. The bores of the sleeves 60, 70 are in fluid communication with the bore 50*b* of the housing 50. The outlet sleeve 70 provides a replaceable "hanger" in the bore for the connection of the other components, and protects the outlet port 52 from erosion damage. It can be readily removed and replaced when damaged by erosion, or if a different size of inner bore is needed.

The valve assembly 1 comprises a resilient device, in this example in the form of a compression spring 80 which circumferentially surrounds a downhole end of the control sleeve 60, and is held in compression to bias the control sleeve 60 upwards in the bore into a first configuration as shown in FIG. 1, in which the bore 1*b* is open and the outlet port 52 is closed. In the first configuration shown in FIG. 1, the spring 80 is held in compression between an optional spring retainer 85 surrounding the control sleeve 60 at the spring's downhole end and abutting against an upwardly facing shoulder in the bore (optionally formed by a sleeve in the bore), and a radially outwardly extending shoulder 61 of the control sleeve 60 at its uphole end. The spring 80 is optionally preloaded in compression in the FIG. 1 state, and urges the control sleeve 60 in an uphole direction within the bore 50*b* until it abuts a lower end 70*l* of the outlet sleeve 70, which limits its further axial travel within the bore 50*b* in the uphole direction, and maintains compression on the spring in this configuration, since the outlet sleeve 70 is fixed in position within the bore 50*b*. The spring 80 can be compressed further as will be described below.

The control sleeve 60 is adapted to slide axially in the bore 50*b*, to open and close at least one alternative fluid pathway in the assembly, in this example to divert the fluid flowing through the bore 50*b* of the housing and the bore 1*b* of the control sleeve 60 out into the annulus of the wellbore, through an outlet port 52 in the housing 50. The outlet sleeve 70 is fixed in the bore 50*b* across the outlet port 52, and has an aperture 72 in the outlet sleeve 70 which is in fluid communication with the outlet port 52. In the first configuration shown in FIG. 1, the control sleeve 60 is positioned within the housing 50 such that an aperture 62 through the control sleeve 60 is out of alignment with the aperture 72 on outlet sleeve 70, closing off fluid communication between the bore 50*b* and the outlet port 52, and maintaining axial fluid flow F1, with the direction of flow as illustrated by the arrow, in a downhole direction within the bore 1*b* of the control sleeve.

The outlet sleeve 70 is fixed in both rotational and axial position by fixing members in the form of pins 54, which are inserted through the wall of the housing 50, into receiving bores in the outlet sleeve 70. The pins 54 can be removed in order to facilitate removal and replacement of the outlet sleeve 70 when necessary, for example in the event of erosion of the aperture 72. The pins 54 further extend radially inwards to engage the outer surface of the control sleeve 60, and are adapted to be received in an indexing track 65 formed in the outer surface of the control sleeve 60 which lies within the bore of the outlet sleeve 70, to control rotational and axial movement of the control sleeve 60 within the housing 50, as will be described below.

The outlet port 52 of the valve assembly 1 is actuated between open and closed configurations to permit and restrict fluid communication between the bore of the valve assembly 50*b* and an external surface of the valve assembly. When the outlet port 52 is in the closed configuration shown in FIG. 1, the outlet port 52 is obturated by the control sleeve 60, which is urged axially upwards relative to the outlet port 52 to cover it in the first configuration. Annular seals are optionally compressed between the outlet sleeve 70 and the control sleeve 80 in axial positions above and below the outlet port, so that in the closed configuration in FIG. 1, the control sleeve seals off all fluid communication between the bore 1*b* and the outlet port 52. The control sleeve 60 has at least one and in this case, two apertures 62 which pass radially through a wall of the control sleeve 60 at the same axial location on the control sleeve 60, and which are spaced diametrically from one another around the circumference of the control sleeve 60. When the control sleeve 60 is in the first configuration shown in FIG. 1, the apertures 62 above the apertures 72, out of axial alignment with the outlet port 52, and in this configuration, the outlet port 52 is closed and the fluid flowing through the bore 50*b* above the valve assembly 1 flows through the bore 1*b* of the control sleeve and on through the tubular string to the drill bit in a generally unobstructed manner.

Figure 2:
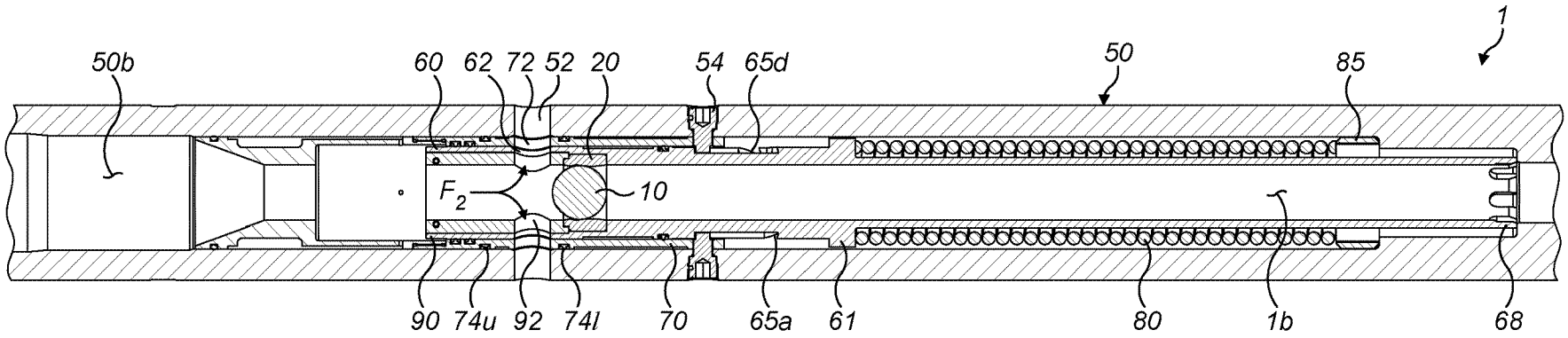
FIG. 2 shows the valve assembly of FIG. 1 in a second (outlet port open) configuration with a valve closure member seated on the valve seat.

When the outlet port 52 is to be opened and fluid flow is to be diverted to the outlet for example in a circulation operation, the control sleeve 60 moves axially down the bore from the first "outlet port closed" configuration shown in FIG. 1, to the second configuration with radial fluid flow F2, as shown in FIG. 2 to open the outlet port 52 as will be described below. The axial travel of the control sleeve 60 can result in the outlet port 52 being fully open (as shown in FIG. 2), fully closed (as shown in FIG. 1), or partially open (an intermediate position between the two).

In this example, the control sleeve 60 further comprises a valve seat 20 situated just below the apertures 62. When the control sleeve 60 is in the first configuration of FIG. 1 and the outlet port 52 is closed the valve seat 20 does not offer any substantial obstruction of the fluid flow through the bore 1*b*. The valve seat 20 is adapted to be sealed by at least one valve closure member, for example, a ball, a dart, a plug etc., and has first and second seat members as will be described below. The valve closure member is normally dropped from surface or otherwise released into the tubular above the seat 20, and travels with the fluid flow in a downhole direction to the seat 20, where its further axial travel in the bore 50*b* is prevented, and it closes or substantially obturates the bore of the control sleeve 60 by seating on the seat 20. FIG. 2 shows the valve assembly 1 of FIG. 1, with a valve closure member in the form of a ball 10 seated on the valve seat 20, and in which the control sleeve 60 has travelled axially in the bore 50*b* under the force of the fluid pressure above the seated ball 10 to uncover the outlet port 52 by aligning the aperture 62 with the aperture 72 and the outlet port 52, so that the bore 50*b* is in fluid communication with the outlet port 52, and fluid is diverted by the seated ball 10 through the outlet port 52 rather than down the bore 1*b* of the control sleeve and onwards through the tubular string to the drill bit below the valve assembly 1.

The seat 20 has first and second seat members 21, 22 in the form of parallel annular rings spaced apart by a short distance, optionally less than the diameter of the ball 10. The seat members 21, 22 each have apexes spaced apart along the axis of the seat 20, with narrow inner diameters, which are narrower than the ball 10. The first seat member 21 on the valve seat 20 is adapted to deform resiliently to allow passage of the non-deformable ball 10 through the deformable resilient seat member 21 under the force of fluid pressure above the ball 10. The valve seat members 21, 22 are adapted to seat the ball and are formed of resilient material, optionally forming a single piece of resilient rubber or plastics material with the seat 20.

The seat members 21, 22 are each adapted to seat the ball 10 in a first configuration. In the first configuration, the first seat member 21 is radially extended inwards into the bore at an apex to an inner diameter that is less than the diameter of the ball 10, and hence the larger ball 10 seats on the first seat member 21 when the seat member 21 is in the first configuration. Each of the seat members 21, 22 is adapted to deform resiliently from the first radially extended configuration seating the ball 10 into a second radially compressed configuration to allow passage of the ball 10 past the apex of each of the seat members when the force urging the ball 10 downwards in the bore overcomes the resilience of the seat member 21, 22 reacting against it. The seat members 21, 22 are axially spaced from one another at an axial distance sufficient to engage the ball 10 and retain it between the first and second seat members 21, 22. The valve seat members 21, 22 extend radially inwards into the bore 1*b* of the control sleeve 60 and each form a ring having a generally hemispherical cross-sectional profile. The inner radial dimension of each seat member 21, 22 in a resting configuration where no force is acting on it is smaller than the maximal radial dimension of the ball 10. The inner radial dimension of each seat member 221, 222 is adapted to expand radially during deformation and axial passage of the ball through the seat member 221, 222, such that the radial thickness of each seat member 221, 222 reduces transiently during deformation. Thus as the ball 10 passes through the valve under the force of the fluid pressure above it, the inner faces of the seat members 21, 22 are resiliently compressed in a radially outward direction by the non-deformable ball 10 acting under the force of fluid pressure directed downhole from the surface. Each seat member 21, 22 advantageously maintains a consistent outer radial dimension and volume in the resting and deformed configurations, and merely changes shape when deforming.

FIG. 2 shows the resting configuration of the first (upper) seat member 21, which has resiliently recovered its original shape, inner diameter, and radial thickness after deformation and passage of the ball 10 through the narrow throat of the first (upper) seat member 21. The first seat member 21 deforms by radial compression from the first resting configuration to the second deformed configuration to allow passage of the ball 10 past the apex of the first seat member 21 to the position shown in FIG. 2. The second (lower) seat member 22 is also adapted to seat the ball 10 when in the first configuration shown in FIG. 2. The second seat member 22 is also adapted to resiliently deform by radial compression from the first resting configuration to a second deformed configuration to allow passage of the ball 10 past the second seat member 22 as will be described below. However, the force required to deform the second seat member 22 is higher than that required to deform the first seat member 21, so in the FIG. 2 configuration, the second seat member 22 has not yet resiliently deformed and retains the ball 10 between the first and second seat members 21, 22, which are axially spaced from one another along the axis of the bore 50*b*.

Figure 8:
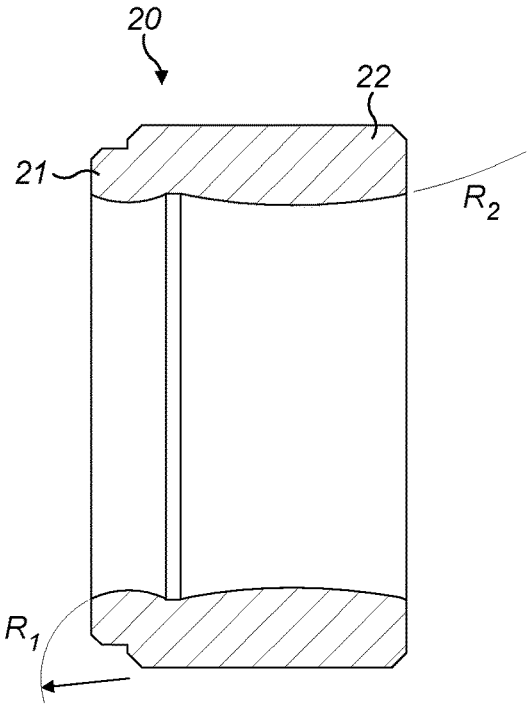

Each seat member 21, 22 has an upper surface and a lower surface, which extend from the inner surface of the bore 1*b* along an arcuate profile having a radius as is best shown in FIG. 8. Each seat member 21, 22 has an apex at the axial midpoint of each seat member 21, 22, which comprises the narrowest parts of a throat of the bore 1*b* of the control sleeve 60, and the seat members meet at an annular cleft between them, having a wider diameter, and the ball 10 is naturally received in the cleft between the seat members 21, 22. The cleft can optionally have an intermediate section of the seat between the two seat members 21, 22. The intermediate section of the seat can optionally extend generally parallel to the axis of the bore for a short distance between the seat members 21, 22, as is best shown in FIG. 8, so that the seat members 21, 22 are axially spaced apart along the seat by a short distance. The seat members 21, 22 create a throat in the seat 20 that is narrower than the bore of the control sleeve 1*b* and the sealing diameter of the ball 10. In this example, the radius of the arcuate side profile of the first seat member 21 is 0.472", smaller than the radius of the arcuate side profile of the second seat member 22 which in this example is 3.034", but in other examples these radii may be equal and constant, and of course the dimensions recited are purely by way of example and are not intended to be limiting. Both arcuate side profiles are optionally symmetrical in and of themselves. The valve seat and the seat members may be manufactured from the same resilient material for increased compressive capacity, which may allow balls of larger diameter to be used and to pass through the valve seat 20. Increasing the diameter of the ball 10 may be useful to increase the surface area that forms the sealing surface between the seat members 21, 22 and the ball 10.

Thus the seat 20 is adapted to retain the ball 10 between the first and second seat members 21, 22 when they are in their first configuration, such that the first and second seat members 21, 22 both seat against the ball 10 at the same time, and press against it from opposite sides (e.g. uphole and downhole). The first and second seat members 21, 22 each at least partly surround a portion of the ball 10 during deformation of the respective seat member.

The first and second seat members 21, 22 resiliently urge the ball 10 in opposite axial directions from opposite axial ends of the ball 10. For example, when the ball 10 is engaged in the seat 20 between the seat members 21, 22, the resilient action of the valve seat members 21, 22 urging the ball from above and below the ball 10 resists movement of the ball 10 relative to the seat 20. The axial urging prevents the ball 10 from dislodging from the valve seat 20 even in deviated wells, for example horizontal, and returning in an uphole direction. It also requires greater fluid pressure to force the ball 10 through the valve in a downhole direction, thus preventing accidental and unpredictable opening of the valve due to the ball 10 passing through the valve seat 20 under the force of normal operative fluid pressures.

Seating of the ball 10 in the seat 20 during fluid flow in the bore 50*b* leads to a build-up of fluid pressure uphole of the valve assembly 1. The build-up of fluid pressure can be accelerated by increased pumping from the surface. At the first threshold pressure the fluid pressure differential across the seated ball 10 begins to overcome the force of the spring 80, which is continuously acting in compression to urge the control sleeve 60 towards the closed configuration. The control sleeve 60 is urged axially under the fluid pressure relative to the outlet port 52 from the initial configuration in which the outlet port is closed towards a circulating configuration in which the outlet port 52 is at least partially in fluid communication with the bore 50*b*.

As the fluid pressure increases and acts on the seated ball member 10, the force of the fluid pushes the control sleeve 60 axially in a downhole direction. The pins 54 allow the control sleeve 60 to translate in an axial direction without a rotational component, thus maintaining the axial alignment of the aperture 62 with the outlet sleeve aperture 72 and the outlet port 52. Thus, in the second configuration shown in FIG. 2, the aperture 62 lines up with the outlet sleeve aperture 72 and the outlet port 52. The movement of the control sleeve 60 compresses the spring 80 between the shoulder 61 on the control sleeve 60 and the spring retainer 85. As the control sleeve 60 moves in a downhole direction relative to the outlet sleeve 70 and the housing 50, the aperture 62 moves into alignment with the aperture 72 and the outlet port 52. The alignment of the aperture 62 with the outlet port 52 allows the pressurised fluid to escape in a radial direction into the annulus of the wellbore for circulation of the fluid above the drill bit for example. These high pressure jets of fluid can be used for, for example, cleaning the annulus, or washing drill cuttings back to the surface. The fluid is prevented from flowing into the space between the housing 50 and the outlet sleeve 70 by a pair of seals situated just uphole (74*u*) and just downhole (74*l*) of the outlet sleeve aperture 72. The space between the control sleeve 60 and the outlet sleeve 70 is similarly sealed off. Thus, the fluid is directed to flow solely out of the outlet port 52 and is prevented from escaping through other paths.

The indexing track 65 and the pins 54 form part of an indexing mechanism adapted to control the change of configuration of the control sleeve 60 between the first and second configurations. The movement of the pins 54 in the track 65 guides rotational movement of the control sleeve relative to the outlet port 52, and ensure that the aperture 62 lines up with the outlet port 52 in the second configuration to allow fluid communication between the annulus and the bore 1*b*. The track 65 is an endless circumferential track in this example, extending continuously around a circumference of the valve assembly, allowing continuous circumferential movement of the pin 54 within the track 65. The track 65 has upper axial limbs 65*u* connected to lower axial limbs 65*l* by transverse ascending 65*a* and descending 65*d* links. The pins 54 are adapted to move the control sleeve continuously in rotation by tracking through the limbs and links in a continuous single direction, which in this example, rotates the control sleeve clockwise relative to the static pins 54 as viewed from the upper end of the string. The direction of rotation is fixed by the interconnections between the axial limbs 65*u*, 65*l* and the transverse links 65*a*, 65*d*. Thus when a pin 54 is tracking though the ascending link 65*a* from the lower limb 65*l*, it can only enter the upper limb 65*u*, and when tracking through the descending link 65*d* it is forced into the lower limb 65*l*.

The upper limbs 65*u,l* are spaced apart circumferentially from one another at 90 degrees around the circumference of the control sleeve 160. Also, the lower limbs 65*u,l* are spaced apart circumferentially from one another at 90 degrees around the circumference of the control sleeve 160 in the same way, but circumferentially offset with respect to the upper limbs by 45 degrees. Hence, the upper and lower limbs are intercalated. In this example, there are four axial lower limbs 65*l* and four axial upper limbs 65*u*. Each upper limb 65*u* has a neighbouring lower limb 65*l* spaced at 45 degrees around the circumference. Two of the upper limbs 65*u* are circumferentially aligned with the outlet apertures 62 in the control sleeve 60, which are separated by 180 degrees as best shown in FIG. 2.

In the FIG. 1 configuration, the pins 54 are in the lower limbs 65*l* of the track. The aperture 62 on the control sleeve 60 is above the aperture 72 on the outlet sleeve 70 and the outlet port 54, and is rotated 45 degrees out of alignment with the outlet port 54. Following the landing of the ball 10 the spring 80 is compressed and the control sleeve 62 moves axially in the bore of the outlet sleeve 70 guided by the pin 54 in the track 65. The pin 54 moves from the lower limb 65*l* into an ascending limb 65*a*, which tracks around the circumference of the control sleeve 60, and causes the control sleeve 60 to rotate through 45 degrees until the pin 54 enters the upper limb 65*u*, at which point the aperture 62 has lined up circumferentially above the outlet port 52, but is still axially spaced away from it. The pin 54 tracks through the upper axial limb 65*u* in an axial direction, guiding the control sleeve 60 axially down so that the aperture 62 lines up with the outlet 54 and the aperture 72, allowing fluid communication between the bore 50*b* above the seat 20 and the outlet port 52, thereby allowing fluid to circulate outside the tool.

The pressure is maintained for as long as circulation is desired, and this keeps the control sleeve in the second configuration shown in FIG. 2, with the outlet port 52 open and the pin 54 in the upper limb 65*u*. When circulation is no longer desired, the pumps can be switched off at surface, and the spring 80 drives the control sleeve 60 back up the bore 50*b* to cut off the outlet port 52 from the bore 50*b* once more. The pin 54 tracks down the upper limb 65*u* and is forced into the descending link 65*d* which rotates the control sleeve 60 45 degrees clockwise and delivers the pin 54 to the lower limb 65*l*. In this configuration, the assembly 1 is in a configuration similar to FIG. 1, with the outlet port closed but with the aperture 62 rotated through 90 degrees in a clockwise direction from the position shown in FIG. 1, because the pin 54 is in the neighbouring axial upper limb 65*a*, spaced circumferentially from the initial position by 90 degrees. In this configuration, the bore 50*b* is not in fluid communication with the outlet port 52, as the aperture 62 is not aligned with it. This is an intermediate closed configuration, not specifically shown in the drawings. The assembly will remain in this configuration until the fluid pressure is again raised to drive the control sleeve down the bore, so various different operations can be carried out before that is triggered.

Figure 3:
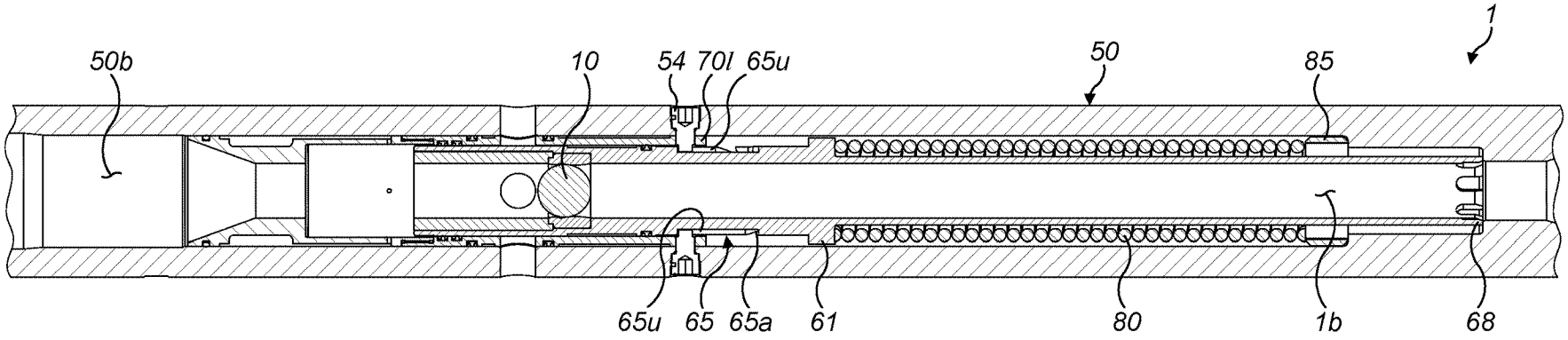
FIG. 3 shows the valve assembly of FIG. 1 in a third (outlet port closed) configuration with a valve closure member seated on the valve seat.
Figure 5:
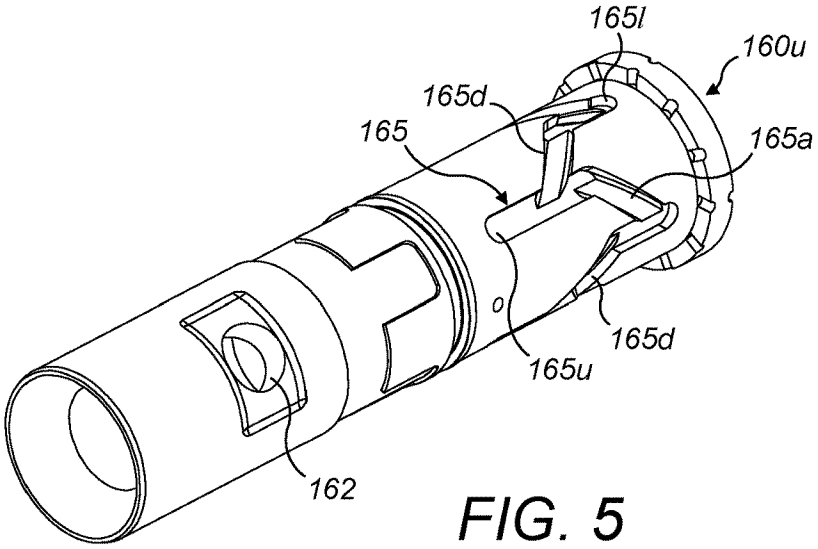
FIG. 5 shows a perspective view of a control sleeve of the valve assembly of FIGS. 9-11.
Figure 4:
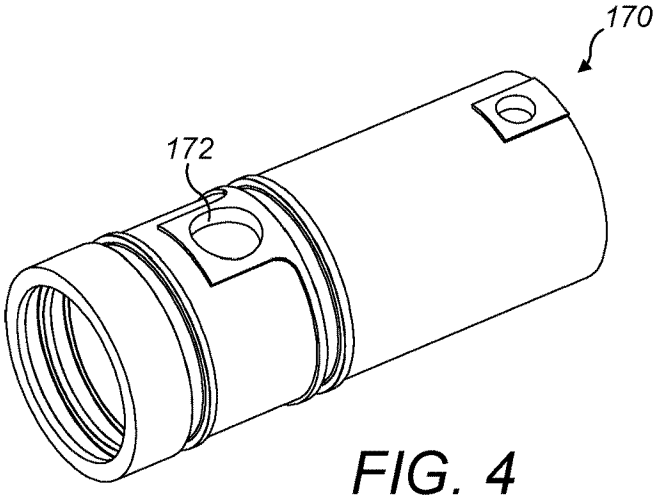
FIG. 4 shows a perspective view of an outlet sleeve of the valve assembly of FIGS. 9-11.
Figure 6:
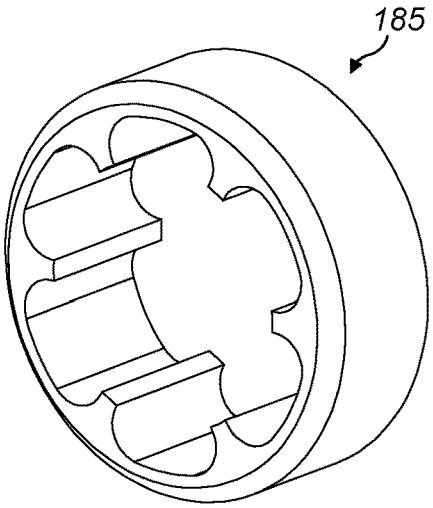
FIG. 6 shows a perspective view of a spring retainer of the valve assembly of FIGS. 9-11.

The assembly can be shifted from the intermediate closed configuration to a third closed configuration shown in FIG. 3 of the drawings, by a further pressure increase, which drives the control sleeve back down the axial upper limb 65*u*, and into the next descending link 65*d* to enter the next lower limb 65*l*. In this configuration, shown in FIG. 3, the outlet port is once more isolated from the bore 50*b* by the control sleeve because although the aperture 62 is axially aligned with the outlet port 52, it is not circumferentially aligned with it, so there is once again substantially no flow to the outlet. From this third closed configuration, the pumps can be switched off, allowing the spring 80 to return the control sleeve 60 axially and rotationally to another intermediate closed configuration as described above, before a further on-off cycle of pressure returns the control sleeve to the FIG. 2 position (but cycled through 90 degrees) to open the outlet port 52 once more. Thus, the first and second configurations can be interposed between intermediate configurations by the indexing mechanism, which can be selected by repeated sequential cycling of the valve assembly as described above. In some of these intermediate configurations, pressure can be applied above the seat to compress the spring, and in some configurations, the spring can overcome the pressure differential across the seat (which can optionally be zero or approaching zero) to unload the spring and force the control sleeve up the bore. In at least one of the intermediate configurations, the outlet port is optionally closed (optionally by rotation of the outlet aperture in the control sleeve out of alignment with the outlet port) so that the pressure in the bore above the seated valve closure member can be increased to the second threshold without loss of fluid pressure through the open outlet port.

Thus sequential cycling of the assembly 1 is possible simply by increasing and decreasing the pressure up to and below the first pressure threshold, causing the control sleeve to rotate in a stepwise fashion as described above, and to connect the bore 50*b* with the outlet port every 180 degrees. Thus one possible sequence of configurations of this example once the ball 10 is seated is as follows:

1) no pressure, control sleeve up, apertures misaligned by −45 degrees, no radial flow, FIG. 1;
2) pressure (to first pressure threshold), control sleeve down, apertures aligned, radial flow possible, FIG. 2;
3) no pressure, control sleeve up, aperture misaligned by +45 degrees, no radial flow (not shown—intermediate position);
4) pressure, control sleeve down, aperture misaligned by +90 degrees, no radial flow, FIG. 3;
5) no pressure, control sleeve up, aperture misaligned by +135 degrees, no radial flow (not shown, second intermediate position);
6) pressure, control sleeve down, apertures aligned, radial flow possible (not shown, but similar to FIG. 2 rotated through 180 degrees).

Thus the assembly can be repeatedly and optionally continuously indexed from open to closed and back to open as many times as is desired by switching the pumps on and off to cycle between the first pressure threshold and a reduced pressure with a single ball seated on the seat. One advantage of this system is that a single ball 10 can be used to both open and close the outlet port 52 during circulation operations, and further balls are not required. The ball 10 remains seated on the seat 20 during the transitions between the different configurations as a result of the higher elastic modulus of the second (lower) seat member 22, which resists deformation and retains the ball 10 on the seat 20 even in the event of increases up to the first pressure threshold tending to dislodge it.

When circulation operations are concluded, the tool is indexed into the closed position shown in FIG. 3 and the pumps are kept active to maintain the pressure while the ball is unseated as described below.

After the circulation operation is concluded, and drilling is to resume, the ball 10 can be unseated from the seat 20. This can be initiated when the control sleeve is in the FIG. 3 configuration, with the outlet port 52 closed off from the bore 50*b* and the ball 10 seated on the seat 20. In order to reset the valve assembly 1 to the initial drilling configuration and to unseat the ball 10, the pumps are driven to increase fluid pressure within the bore 50*b* above the seated ball 10*a* to a second fluid pressure threshold that is optionally higher than the first fluid pressure threshold. The fluid pressure acts on the seated ball 10. Once the fluid pressure above the obturated bore has increased to a level at which the force urging the ball 10 downwards in the bore 1*b* is greater than the resilient force maintaining the ball 10 on the second seat member 22, the higher force exerted by the fluid forces the ball 10 through the second seat member 22, which resiliently deforms as the ball 10 passes through it, before returning to its original configuration. The ball 10 can optionally be caught in a ball catcher device (not shown) after it has passed through the seat 20.

The first and second pressure thresholds can optionally vary in different examples, but an optional first pressure threshold could be similar to what a wellbore would withstand in a normal circulation operation. In the present example, a suitable pressure to open the ports and allow flow is around 100-300 psi (approximately 690-2070 kPA), for example, 150 psi (approximately 1030 kPa), which is optionally sufficient to overcome the force of the spring, and the resilience of the first seat member 21, but not the resilience of the second seat member 22. The second pressure threshold is optionally higher than the first pressure threshold, and could be from 1000-2000 psi (approximately 7-14 MPa), for example 1500 psi (approximately 10 MPa) and is optionally sufficient to overcome the resilience of the second seat member 22 and to shear the ball 10 from the seat 20. The spring strength is optionally chosen in light of the likely operating pressure which will influence the desired first pressure threshold.

Once the ball 10 has passed through the valve seat 20, the obstruction of fluid flow through the bores 50*b*, 1*b* is removed, and the fluid pressure drops suddenly, reducing below the level needed to compress the spring 80. The spring 80 then returns the control sleeve 60 under its upward biasing force to the initial first configuration, where the aperture 62 is situated uphole of the outlet sleeve aperture 72, out of alignment with the aperture 72 and the outlet port 52, and the outlet port 52 is closed off from the bore 50*b* by the control sleeve 60 and its seals. Fluid flow through the radial pathway F2 is thus prevented and flow resumes along the axial pathway F1. Drilling can then resume with the fluid being directed to the drill bit to wash cuttings back to the surface.

In one example, the control sleeve 60 optionally includes a cap, disposed at the uphole end of the control sleeve, which is optionally threadedly connected to the control sleeve 60. The cap 67 optionally includes a bladed component, which is urged resiliently against the inner surface of the wall of the outlet sleeve 70, and in one example is in the form of a resilient wiper, but a rigid scraper or similar could also or alternatively be provided. The wiper can be formed from a resilient material, for example a plastic or rubber material. The wiper covers the upper end of the annulus between the control sleeve and the outlet sleeve, and reduces the amount of debris accumulating therein. As the control sleeve moves in the bore of the outlet sleeve, the wiper scrapes against the inner surface of the outlet sleeve and cleans off debris. The inner diameter of the cap is larger than the inner diameter of the valve seat, in order to avoid any erroneous seating of the ball in the cap before it reaches the seat 20.

At the uphole edge of the outlet sleeve 70, there is a leading edge 40 facing in an uphole direction, against the fluid flow F. The outer wall of the outlet sleeve 70 is cylindrical with parallel sides to match the inner bore 50*b*, but the inner wall 75*w* of the bore 70*b* at the uphole end optionally has a shaped profile which tapers radially inwards into the bore of the outlet sleeve 70 to a throat 70*t*, which is narrower than the upper end of the bore 70*b* of the outlet sleeve 70, but wider than the seat 20. The inner wall of the outlet sleeve 70 therefore forms a funnel 75 in the bore, which acts to reduce turbulence and drag within the flow of the fluid, and to smooth out any eddies that would otherwise have been created by the upper end of the outlet sleeve 70. The funnel 75 provided by the inner wall directs fluid into the bore 1*b* of the control sleeve 60, with a diameter that is at least equal to the diameter of the bore 1*b*, but can optionally be less than the diameter of the bore 1*b*. The funnel disrupts the flow of the fluid uphole of the seat, increasing the velocity of the fluid passing through the nozzle of the funnel and hence reduces the downward thrust in the bore above the seat 20 in accordance with Bernoulli's law, so that the sleeve 60 is subjected to less downward thrust, and is less likely to shift axially to the second configuration without the ball 10*a* being seated on the seat 20.

In another optional feature, the control sleeve 60 is optionally castellated at 68 at its downhole end. In this example, these castellations 68 are in the form of arches cut out of the sleeve material, but other shapes may be used. The castellations 68 permit fluid flow through the arches to the annular space in between the control sleeve 60 and the valve housing 50, into the cavity where the spring 80 is retained. In this case, when the control sleeve 60 moves in a downhole direction, the spring is free to compress as fluid is forced out of the cavity through the castellations 68 and into the bore 50*b*. Similarly, when the control sleeve 60 is travelling back in an uphole direction to its initial configuration, the spring 80 must extend, and fluid can flow through the castellations 68 into the spring cavity to fill the vacuum that the extension creates. This feature reduces the risk of hydraulic lock of the control sleeve 60. The spring retainer 85 likewise has similar formations allowing fluid communication and preventing or alleviating risks of hydraulic locking of the moving parts of the assembly 1.

An operation using the above example will now be described. During wellbore operations, for example downhole drilling, fluid is normally pumped axially down the drill string to the drill bit for cooling the bit, and for washing cuttings back to the surface. The option of diverting the fluid being pumped down the bore of the string into a radial fluid flowpath can be desirable in order to e.g. clean drill cuttings from the annulus of the wellbore. In this example, the ball 10 is dropped from the surface and travels through the bore of the string under the combined force of gravity and fluid being pumped down the well by positive displacement pumps at the surface. The ball 10 enters the bore 50*b* of the valve assembly 1 and passes through the funnel 75 of the outlet sleeve 70, passing the control sleeve aperture 62 before landing on the seat 20. When engaged with the seat 20, the non-deformable ball 10 forces deformation of the resilient first (upper) seat member 21 under the initial force of fluid pressure in the bore behind the ball 10. As the ball 10 passes through throat of the seat member 21, the seat member 21 is radially compressed by the ball 10, such that its radial thickness is reduced and the diameter of the bore increases in a transient and reversible manner, but while the outer diameter of the seat member 21 and the volume remain unchanged. The second resilient seat member 22, being in this example larger than seat member 21, requires more force to deform and allow passage of the ball 10 past the apex of the seat member 22. The ball 10 is thus held within the cleft in the seat 20, below the apex of the first seat member 21 and above the apex of the second seat member 22, and is retained there under the opposing axial urging forces that the seat members 21, 22 apply to the ball's uphole- and downhole-facing surfaces.

The seating of the ball 10 in the seat 20 obturates the axial fluid flowpath F1, as the seat members 21, 22 sealingly engage with at least a circumferentially-extending portion of the surface of the ball 10. The resulting increase in fluid pressure uphole of the valve assembly 1 and into the bore 50*b* applies a correspondingly increasing force to the uphole-facing surface of the seated ball 10. Once the fluid pressure has reached a threshold where the force applied to the ball 10 is greater than the opposing biasing force of the spring 80, the control sleeve 60 begins to travel axially in a downhole direction, and is guided in rotation by the indexing mechanism. The inner ends of the pins 54 occupying the various parts of the track 65 on the outer surface of the control sleeve 60 guide the rotation and axial movement of the control sleeve 60 necessary to move the control sleeve between the different configurations referred to above. Sequential increases and decreases in the pressure drive the control sleeve 60 through the various different stages set out above, while the ball 10 remains seated on the seat 20.

Once the operations requiring the radial flow of fluid into the annulus have been concluded, and the operator wishes to return the fluid flow to an axial direction through the valve assembly 1, the assembly is cycled to the FIG. 3 configuration, and the pressure is increased using the surface pumps to a second pressure threshold which is higher than the first threshold pressure. This increases the force bearing down on the seated ball 10, and drives it down the bore 1*b* to deform the second valve seat member 22. The ball 10 causes the seat member 22 to compress in a radially outward direction, transiently increasing the diameter of the bore formed by the seat member 22 (while optionally maintaining outer diameter and volume), and allowing the ball 10 to pass through the seat member 22 and through the rest of the seat 20. The ball 10 is optionally caught in a ball catcher downhole of the valve assembly (not shown), and the second seat member 22 meanwhile returns to its initial uncompressed configuration.

Once the ball 10 has escaped from the second seat member 22 and passed through the valve seat 20, bore is once again open, the fluid pressure is relieved, and there is nothing to maintain the compression of the spring 80 which returns the control sleeve 60 to its original upper position. As the control sleeve 60 moves in an uphole direction, the wiper wipes against the inner surface of the outlet sleeve 70 and cleans away debris, reducing the risk of the control sleeve 60 jamming and maintaining the smooth running of the control sleeve within the outlet sleeve 70, and keeping any debris from entering the annulus between the control sleeve 60 and the outlet sleeve 70, and degrading the seals therein. Once the control sleeve 60 has returned to its initial position, the aperture 62 has rotated and translated axially back to the first position wholly out of alignment with the aperture 72 and the outlet port 52 and the fluid flow returns to an axial path, shown as arrow F1 in FIG. 1.

Thus examples of the present apparatus and method can avoid the need to drop a secondary operating ball to open the bore.

Figure 9:
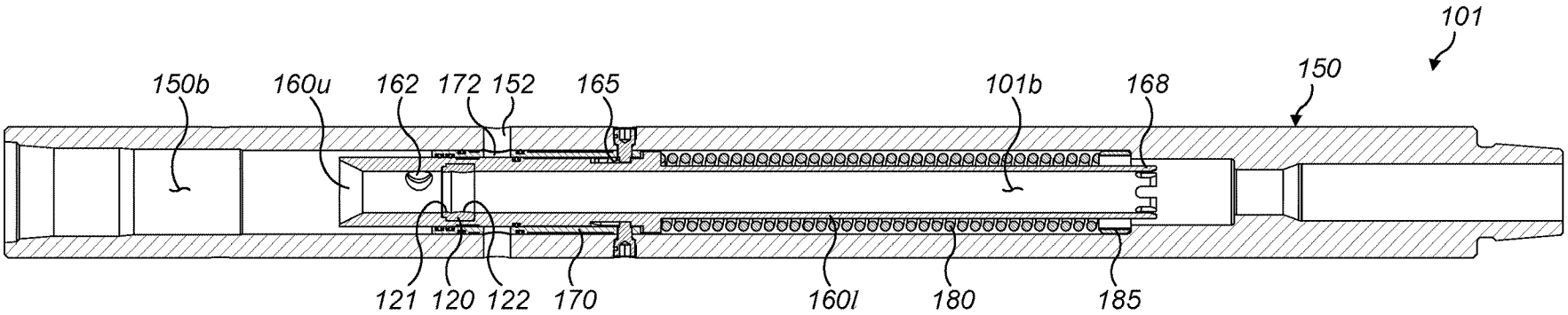
FIGS. 9-11 show views of a second example of a valve assembly similar to FIGS. 1-3.
Figure 10:
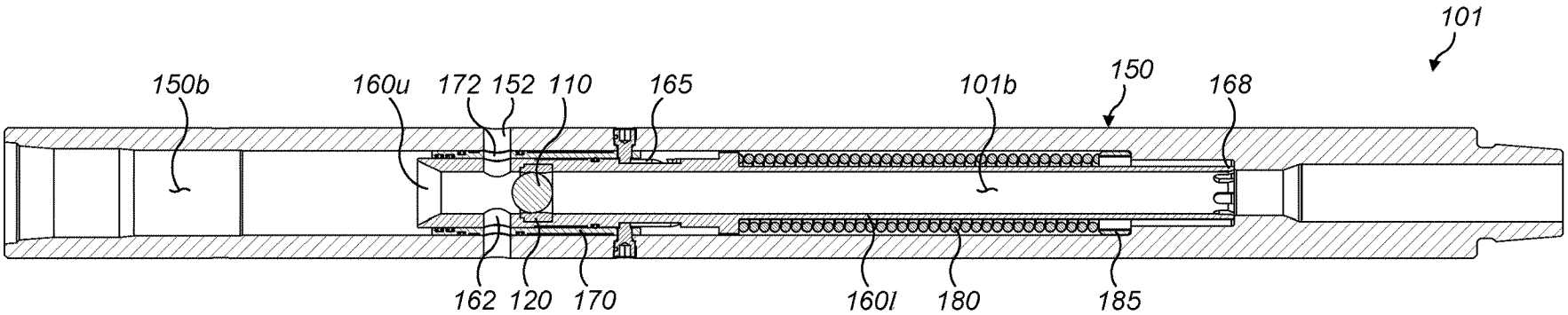
Figure 11:
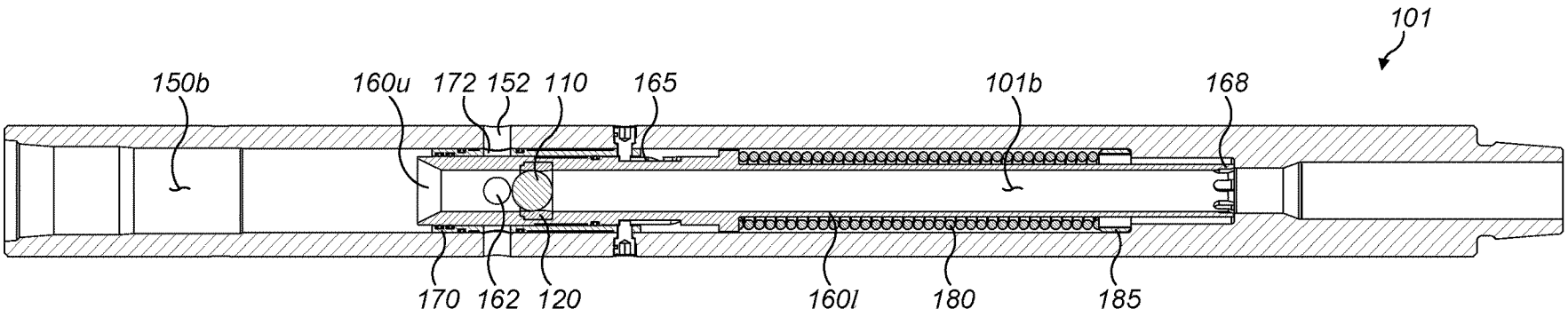

FIGS. 9-11 show an alternative example of the apparatus, with the parts of the apparatus that correspond to the same parts in the first example being denoted by the same reference numbers increased by 100. The features of this example can be combined with the other examples disclosed herein. A valve assembly 101, for use in a wellbore of an oil, gas or water well, comprises a housing 150 having a bore 150*b* in fluid communication with the bore of the string of tubulars in which the valve assembly is integrated. The bore 150*b* houses an outlet sleeve 170 and a control sleeve 160. The outlet sleeve 170 at least partly surrounds a portion of a control sleeve 160, which has a bore 101*b* with an axis that is generally co-axial with the bore 150*b* of the housing and the bore of the outlet sleeve 170. The bores of the sleeves 160, 170 are in fluid communication with the bore 150*b* of the housing 150.

The valve assembly 101 operates in substantially the same way as the valve assembly 1 described above, and thus the similar components and method of operation are not described again here for brevity, and the reader is directed to the description of valve assembly 1 above.

The ball 110 is dropped from the surface landing on the seat 120, and forces deformation of the resilient first (upper) seat member 121 so that it is held within a cleft in the seat 120 between the first and second seat members 121, 122 as described above. This obturates the axial fluid flowpath F1, and shifts the control sleeve 160 to align the aperture 162 with the aperture 172 to open the outlet port 152 and compress the spring 180 as described above. Release of the ball 110 from the seat 120 is as previously described for the first example. As with the first example, sequential increases and decreases in the pressure drive the control sleeve 160 through the various different stages, while the ball 110 remains seated on the seat 120.

The control sleeve 160 in this example comprises two parts, an upper portion 160*u* and a lower portion 160*l*. The upper portion 160*u* has and aperture and an indexing track 165 as described above, and the lower portion 160*l* extends down through the bore, with the spring 180 disposed between the inner surface of the bore 150*b* and the outer surface of the lower portion 165*l*. The lower portion 165*l* has the castellations 168 and the spring retainer 185 as described above. The seat 120 is held between the two portions 165*u*, 165*l* which are connected by a pin in this example, or by screw threads or another form of connection, thereby facilitating assembly, disassembly and replacement of the seat 120 during servicing. The connection between the two portions does not need to be able to withstand significant forces as the lower sleeve 160*l* is normally biased upwardly into the bore of the upper sleeve 160*u* by the spring 180. The seat 120 is otherwise similar in structure and function to the seat 20 described above.

FIGS. 12-16 show an alternative example of the apparatus, with the parts of the apparatus that correspond to the same parts in the first example being denoted by the same reference numbers increased by 100 from the latter example, and by 200 from the first example. The features of this example can be combined with the other examples disclosed herein. A valve assembly 201 for use in a wellbore of an oil, gas or water well, comprises a housing 250 as described in the first example, having a bore 250*b* in fluid communication with the bore of the string, where the bore 250*b* has an outlet sleeve 270 and a control sleeve 260 as described in the first example above, where the control sleeve 260 has a bore 201*b*.

The valve assembly 201 comprises a resilient device, in this example in the form of a compression spring 280 as described in the first example.

The outlet sleeve 270 is fixed in both rotational and axial position by fixing members in the form of pins 254, which are inserted through the wall of the housing 250, into receiving bores in the outlet sleeve 270. The pins 254 can be removed in order to facilitate removal and replacement of the outlet sleeve 270 when necessary, for example in the event of erosion of the aperture 272. The pins 254 further extend radially inwards to engage the outer surface of the control sleeve 260, and are adapted to be received in axial slots in the outer surface of the control sleeve 260 in the bore of the outlet sleeve 270, to restrict rotational movement of the control sleeve 260 while permitting relative axial movement of the control sleeve 260 within the housing 250.

Figure 12:
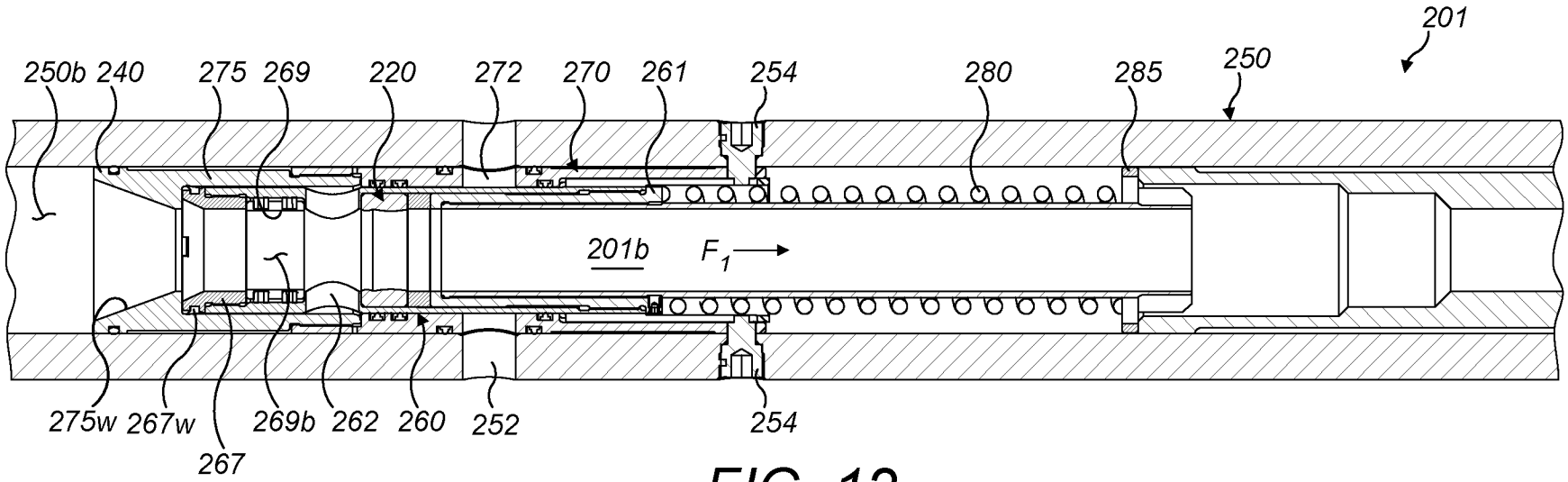
FIG. 12 shows a cutaway view of a valve assembly in a first (outlet port closed and central bore open) configuration with no valve closure member seated.
Figure 13:
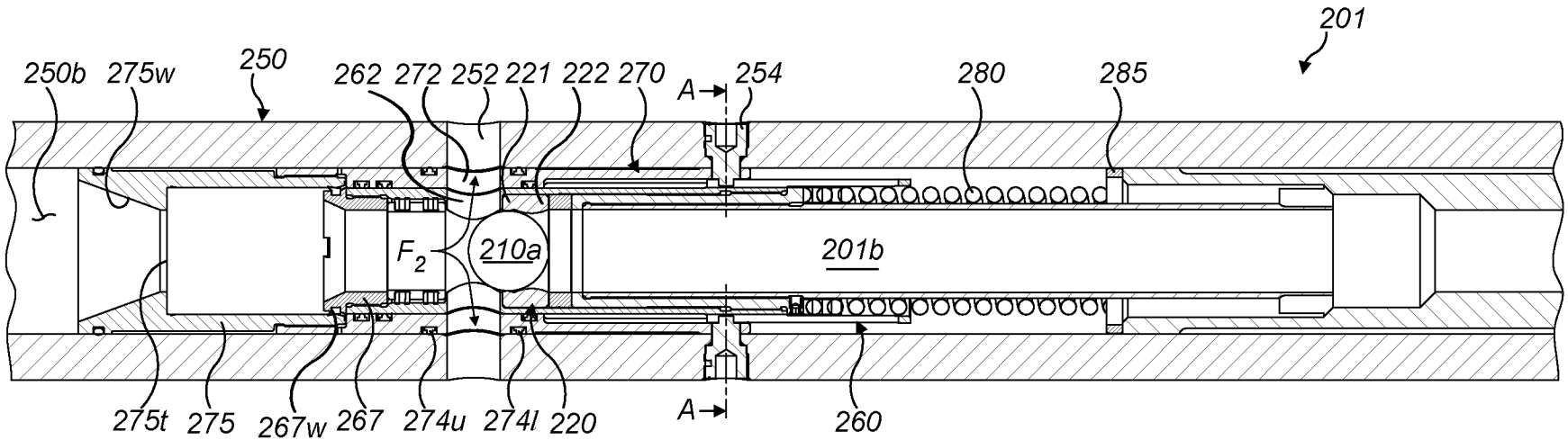
FIG. 13 shows the valve assembly of FIG. 12 with a first valve closure member seated on the valve seat.
Figure 14:
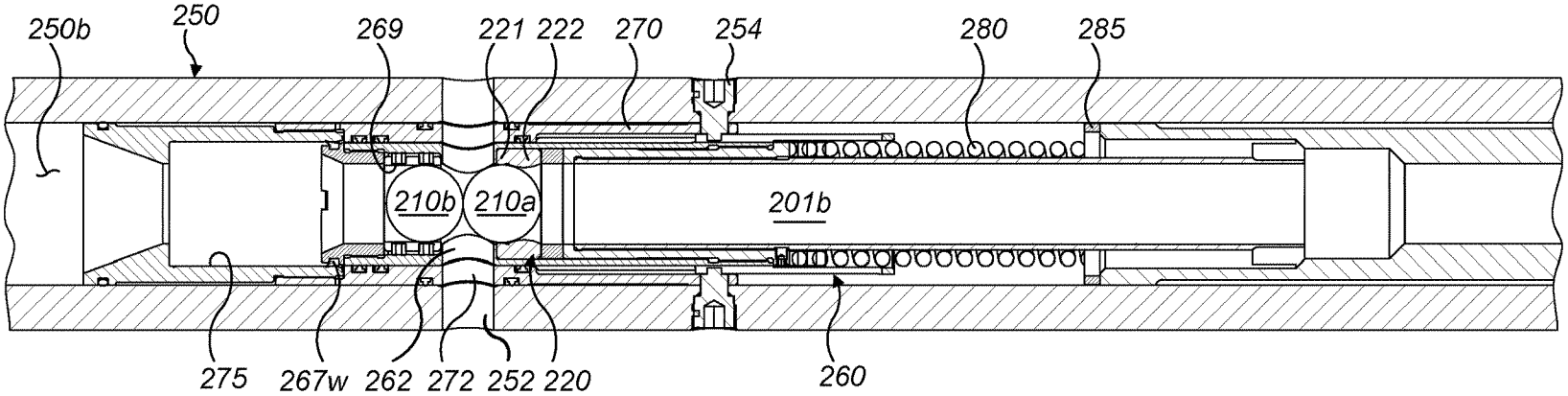
FIG. 14 shows the valve assembly of FIG. 13 with a further valve closure member disposed uphole of and abutting the first valve closure member.
Figure 15:
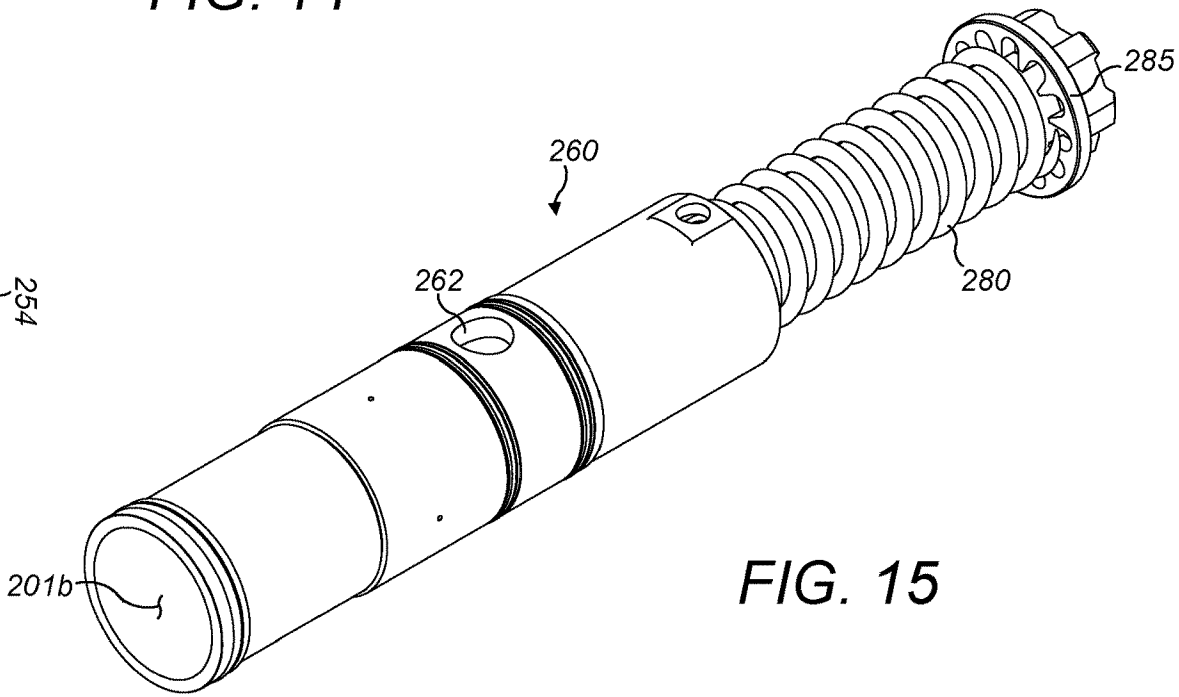
FIG. 15 shows a perspective view of a control sleeve of the FIG. 12 assembly.
Figure 16:
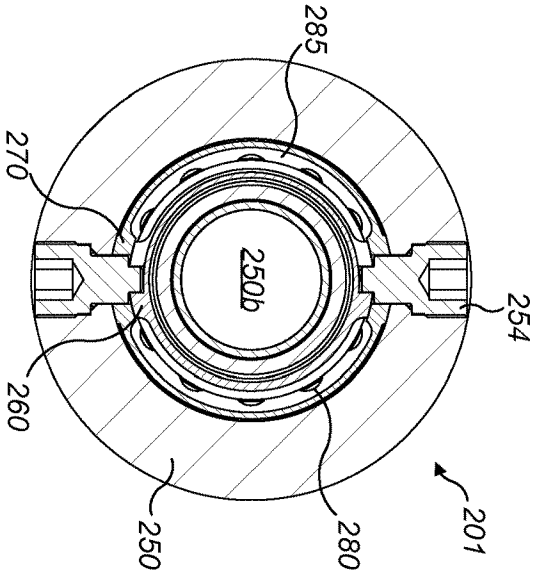
FIG. 16 shows a view along the axis of the valve assembly of FIG. 12.

When the outlet port 252 is to be opened and fluid flow is to be diverted to the outlet for example in a circulation operation, the control sleeve 260 moves axially down the bore from the first configuration shown in FIG. 12, with axial fluid flow $F_1$, to the second configuration with radial fluid flow $F_2$, as shown in FIG. 13, to open the outlet port 252 as will be described below. The axial travel of the control sleeve 260 can result in the outlet port 252 being fully open (as shown in FIG. 13), fully closed (as shown in FIG. 12), or partially open (an intermediate position between the two).

Figure 7:
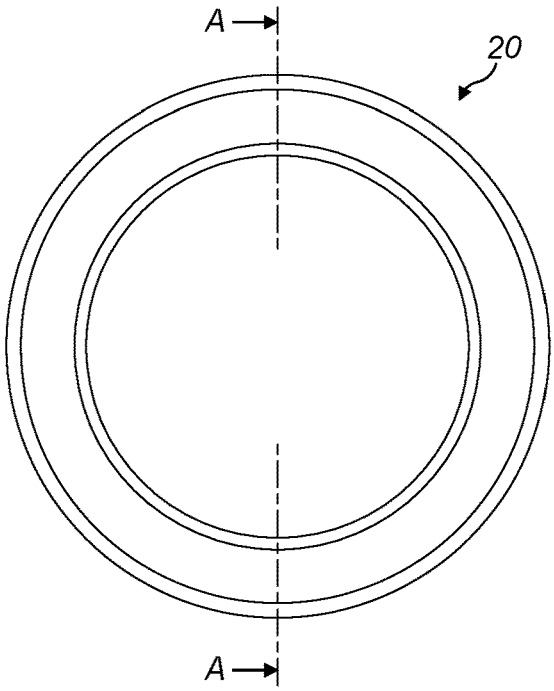
FIGS. 7 and 8 shows end and side views of the valve seat of the valve assembly of FIGS. 1-11.

In this example, the control sleeve 260 further comprises a valve seat 220 situated below the outlet sleeve apertures 262. The valve seat 220 is essentially the same as the seat 20 described in the previous example and shown in FIGS. 7 and 8. The common features of the valve seat 220 shared with the seat 20 will therefore not be described again for the sake of brevity, but the reader is directed to the description of the previous example for the disclosure of these features. When the control sleeve 260 is in the first configuration of FIG. 12 and the outlet port 252 is closed the valve seat 220 does not offer any substantial obstruction of the fluid flow through the bore 201*b*. The valve seat 220 is adapted to be sealed by at least one valve closure member, for example, a ball, a dart, a plug etc., and has first and second seat members as will be described below. The valve closure member is normally dropped from surface or otherwise released into the tubular above the seat 220, and travels with the fluid flow in a downhole direction to the seat 220, where its further axial travel in the bore 250*b* is prevented, and it closes or substantially obturates the bore of the control sleeve 260 by seating on the seat 220. FIG. 13 shows the valve assembly 201 of FIG. 12, with a first valve closure member in the form of a first ball 210*a* seated on the valve seat 220, and in which the control sleeve 260 has travelled axially in the bore 250*b* under the force of the fluid pressure above the seated ball 210*a* to uncover the outlet port 252 by aligning the aperture 262 with the aperture 272 and the outlet port 252, so that the bore 250*b* is in fluid communication with the outlet port 252, and fluid is diverted by the seated ball 210*a* through the outlet port 252 rather than down the bore 201*b* of the control sleeve and onwards through the tubular string to the drill bit below the valve assembly 201.

The seat 220 has first and second seat members 221, 222 in the form of parallel annular rings spaced apart by a short distance, optionally less than the diameter of the ball 210*a*. The first seat member 221 on the valve seat 220 is adapted to deform resiliently to allow passage of the non-deformable ball 210*a* through the deformable resilient seat member 221 under the force of fluid pressure above the ball 210*a*. The valve seat members 221, 222 are adapted to seat the at least one valve closure member and are formed of resilient material, optionally as a single piece of resilient rubber or plastics material with the seat 220.

The seat members 221, 222 are each adapted to seat the at least one valve closure member in a first configuration. In the first configuration, the first seat member is radially extended inwards into the bore to an inner diameter that is less than the diameter of the ball, and hence the larger ball seats on the first seat member 221 when it is in the first configuration. Each of the seat members 221, 222 is adapted to deform resiliently from the first radially extended configuration seating the ball 210*a* into a second radially compressed configuration to allow passage of the ball 210*a* past the seat members when the force urging the ball 210*a* downwards in the bore overcomes the resilience of the seat member 221, 222 reacting against it. The seat members are axially spaced from one another at an axial distance sufficient to engage the ball and retain it between the first and second seat members. The valve seat members 221, 222 extend radially inwards into the bore 201*b* of the control sleeve 260 and each form a ring having a generally hemispherical cross-sectional profile. The inner radial dimension of each seat member 221, 222 in a resting configuration where no force is acting on it is smaller than the maximal radial dimension of the ball 210*a*. The inner radial dimension of each seat member 221, 222 is adapted to expand radially during deformation and axial passage of the ball through the seat member 221, 222, such that the radial thickness of each seat member 221, 222 reduces transiently during deformation. Thus as the ball 210*a* passes through the valve under the force of the fluid pressure above it, the inner faces of the seat members 221, 222 are resiliently compressed in a radially outward direction by the non-deformable ball 210*a* acting under the force of fluid pressure directed downhole from the surface. Each seat member 221, 222 optionally maintains a consistent outer radial dimension and volume in the resting and deformed configurations, and merely changes shape when deforming.

FIG. 13 shows the resting configuration of the first (upper) seat member 221, which has resiliently recovered its original shape, inner diameter, and radial thickness after deformation and passage of the ball 210*a* through the narrow throat of the first (upper) seat member 221. The first seat member 221 deforms by radial compression from the first resting configuration to the second deformed configuration to allow passage of the ball 210*a* past the apex of the first seat member 221 to the position shown in FIG. 13. The second (lower) seat member 222 is also adapted to seat the ball 210*a* in the configuration shown in FIG. 13. The second seat member 222 is also adapted to resiliently deform by radial compression from the first resting configuration to a second deformed configuration to allow passage of the ball 210*a* past the apex of the second seat member 222 as will be described below. However, the force required to deform the second seat member 222 is higher than that required to deform the first seat member 221, so in the FIG. 13 configuration, the second seat member 222 has not yet resiliently deformed and retains the ball 210*a* between the first and second seat members 221, 222, which are axially spaced from one another along the axis of the bore 250*b*.

Each seat member 221, 222 has an upper surface and a lower surface, which extend from the inner surface of the bore 201*b* along an arcuate profile having a radius as shown in FIG. 8. Each seat member 221, 222 has an apex at the axial midpoint of each seat member 221, 222, which comprises the narrowest parts of a throat of the bore 201*b* of the control sleeve 260, and the seat members meet at a cleft between them, having a wider diameter, and the ball 210*a* is naturally received in the cleft between the seat members 221, 222. The cleft can optionally have an intermediate section of the seat between the two seat members 221, 222. The intermediate section of the seat can optionally extend generally parallel to the axis of the bore for a short distance between the seat members 221, 222, as is best shown in FIG. 8 for the first example which is substantially the same in this respect, so that the seat members 221, 222 are axially spaced apart along the seat by a short distance. The seat members 221, 222 create a throat in the seat 220 that is narrower than the bore of the control sleeve 201*b* and the sealing diameter of the ball 210*a*. In this example, the radius of the arcuate side profile of the first seat member 221 is 0.472", smaller than the radius of the arcuate side profile of the second seat member 222 which in this example is 3.034", but in other examples these radii may be equal and constant, and of course the dimensions recited are purely by way of example and are not intended to be limiting. Both arcuate side profiles are optionally symmetrical in and of themselves. The valve seat and the seat members may be manufactured from the same resilient material for increased compressive capacity, which may allow balls of larger diameter to be used and to pass through the valve seat 220. Increasing the diameter of the ball 210*a* may be useful to increase the surface area that forms the sealing surface between the seat members 221, 222 and the ball 210*a*.

Thus the seat 220 is adapted to retain the ball 210*a* between the first and second seat members 221, 22 in their first configuration, such that the first and second seat members 221, 222 both seat against the ball 210*a* at the same time and press against it from opposite sides (above and below). The first and second seat members 221, 222 each at least partly surround a portion of the ball 210*a* during deformation of the respective seat member.

The first and second seat members 221, 222 resiliently urge the ball 210*a* in opposite axial directions from opposite axial ends of the ball 210*a*. For example, when the ball 210*a* is engaged in the seat 220 between the seat members 221, 222, the resilient action of the valve seat members 221, 222 urging the ball from above and below the ball 210*a* resists movement of the ball 210*a* relative to the seat 220. The axial urging prevents the ball 210*a* from dislodging from the valve seat 220 even in deviated wells, for example horizontal, and returning in an uphole direction. It also requires greater fluid pressure to force the ball 210*a* through the valve in a downhole direction, thus preventing accidental and unpredictable opening of the valve due to the ball 210*a* passing through the valve seat 220 under the force of normal operative fluid pressures.

Seating of the ball 210*a* in the seat 220 during fluid flow in the bore 250*b* leads to a build-up of fluid pressure uphole of the valve assembly 201. The build-up of fluid pressure can be accelerated by increased pumping from the surface. At the first threshold pressure the fluid pressure differential across the seated ball 210*a* begins to overcome the force of the spring 280, which is continuously acting in compression to urge the control sleeve 260 towards the closed configuration. The control sleeve 260 is urged axially under the fluid pressure relative to the outlet port 252 from the initial configuration in which the outlet port is closed towards a circulating configuration in which the outlet port 252 is at least partially in fluid communication with the bore 250*b*.

As the fluid pressure increases and acts on the seated ball member 210*a*, the force of the fluid pushes the control sleeve 260 axially in a downhole direction. The pins 254 allow the control sleeve 260 to translate in an axial direction without a rotational component, thus maintaining the axial alignment of the aperture 262 with the outlet sleeve aperture 272 and the outlet port 252. The movement of the control sleeve 260 compresses the spring 280 between the shoulder 261 on the control sleeve 260 and the spring retainer 285. As the control sleeve 260 moves in a downhole direction relative to the outlet sleeve 270 and the housing 250, the aperture 262 moves into alignment with the aperture 272 and the outlet port 252. The alignment of the aperture 262 with the outlet port 252 allows the pressurised fluid to escape in a radial direction into the annulus of the wellbore for circulation of the fluid above the drill bit for example. These high pressure jets of fluid can be used for, for example, cleaning the annulus, or washing drill cuttings back to the surface. The fluid is prevented from flowing into the space between the housing 250 and the outlet sleeve 270 by a pair of seals situated just uphole (274*u*) and just downhole (274*l*) of the outlet sleeve aperture 272. The space between the control sleeve 260 and the outlet sleeve 270 is similarly sealed off. Thus, the fluid is directed to flow solely out of the outlet port 252 and is prevented from escaping through other paths.

After the circulation operation is concluded, and drilling is to resume, the ball 210*a* can be unseated from the seat 220. This can be initiated when the control sleeve is still in the FIG. 13 configuration, with the outlet port 252 radially aligned with the control sleeve aperture 262 and the ball 210*a* seated on the seat 220. In order to reset the valve assembly 201 to the initial drilling configuration and to unseat the ball 210*a*, a second valve closure member in the form of a ball 210*b* is inserted into the bore 250*b* of the housing 250 above the seat 220 while the first ball 210*a* is seated between the valve seat members 221, 222, and is retained in the seat 220. The second or further ball 210*b* lands on the upper surface of the seated first ball 210*a*. The dimensions of the first and second balls 210*a*, 210*b*, are chosen so that when the second ball 210*b* has landed on and is abutting the first, seated, ball 210*a*, the second ball 210*b* substantially reduces or seals off the bore 201*b* of the control sleeve 260 above the aperture 262, thereby substantially obturating the control sleeve 260 and effectively preventing escape of the fluid through the outlet port 252. Complete closure of the bore above the aperture 262 is not needed, and it is sufficient for the second ball 210*b* to block most of the cross-sectional flow area of the bore of the control sleeve 260. A landing sleeve 269 is optionally disposed above the outlet aperture 262, on the opposite side of the outlet aperture from the seat 220, and having a narrowed bore 269*b* to receive the ball 210*b* and to create an optimal flow path which can be traversed by the ball 210*b*, but does not allow any substantial fluid flow, with an optional clearance between the ball 210*b* and the landing sleeve 269 of less than 1 mm for example. Fluid pressure within the bore 250*b* above the second ball 210*b* then builds up further to a second fluid pressure threshold that is optionally higher than the first fluid pressure threshold, which again can be driven from the surface. Alternatively, the fluid pressure can be maintained at a constant value. The diameter of the second ball can be selected to offer the desired percentage of obturation of the bore 250*b*. The fluid pressure acts on the uphole faces of at least one of the first and/or second balls 210*a*, 210*b*. Once the fluid pressure above the obturated bore has increased to a level at which the force urging the balls 210*b*, 210*a* downwards in the bore 260*b* is greater than the resilient force maintaining the ball 210*a* on the second seat member 222, the higher force exerted by the fluid forces the first ball 210*a* through the second seat member 222, which resiliently deforms as the ball 210*a* passes through it, before returning to its original configuration. The second ball 210*b* optionally has a smaller diameter than the diameter of the bore through the valve seat 220, and so the second ball 210*b* passes more easily through the seat 220 without substantially seating on the seat members 221, 222. The balls 210*a*, 210*b* are optionally caught in a ball catcher device (not shown) after they have passed through the seat 220.

The first and second pressure thresholds can optionally vary in different examples, but an optional first pressure threshold could be similar to what a wellbore would withstand in a normal circulation operation. In the present example, a suitable pressure to open the ports and allow flow is around 100-300 psi (approximately 690-2070 kPA), for example, 150 psi (approximately 1030 kPa), which is optionally sufficient to overcome the force of the spring, and the resilience of the first seat member 221, but not the resilience of the second seat member 222. The second pressure threshold is optionally higher than the first pressure threshold, and could be from 1000-2000 psi (approximately 7-14 MPa), for example 1500 psi (approximately 10 MPa), and is optionally sufficient to overcome the resilience of the second seat member 222 and to shear the ball 210*a* from the seat 220. The spring strength is optionally chosen in light of the likely operating pressure which will influence the desired first pressure threshold.

Once the balls 210*a*, 210*b* have passed through the valve seat 220, the obstruction of fluid flow through the bores 250*b*, 201*b* is removed, and the fluid pressure drops suddenly, reducing below the level needed to compress the spring 280. The spring 280 then returns the control sleeve 260 under its upward biasing force to the initial first configuration, where the aperture 262 is situated uphole of the outlet sleeve aperture 272, out of alignment with the aperture 272 and the outlet port 252, and the outlet port 252 is closed off from the bore 250*b* by the control sleeve 260 and its seals. Fluid flow through the radial pathway $F_2$ is thus prevented and flow resumes along the axial pathway $F_1$. Drilling can then resume with the fluid being directed to the drill bit to wash cuttings back to the surface.

In the present example, the control sleeve 260 includes a cap 267, disposed at the uphole end of the control sleeve, which in this example is threadedly connected to the control sleeve 260. The cap 267 includes a bladed component, which is urged resiliently against the inner surface of the wall of the outlet sleeve 270, and in this example is in the form of a resilient wiper 267*w*, but a rigid scraper or similar could also or alternatively be provided. The wiper 267*w* can be formed from a resilient material, for example a plastic or rubber material. The wiper 267*w* covers the upper end of the annulus between the control sleeve 260 and the outlet sleeve 270, and reduces the amount of debris accumulating therein. As the control sleeve moves in the bore of the outlet sleeve 270, the wiper 267*w* scrapes against the inner surface of the outlet sleeve and cleans off debris. The inner diameter of the cap 267 is larger than the inner diameter of the valve seat 220, in order to avoid any erroneous seating of the ball 210*a* in the cap 267 before it reaches the seat 220.

The threaded connection of the cap 267 with the control sleeve 260 allows removal of the component for repair or replacement without requiring complete disassembly of the other valve sleeves. This also permits, for example, the insertion of components to narrow the bore of the control sleeve 260 further for use with different sizes of balls or other shapes of plugs.

At the uphole edge of the outlet sleeve 270, there is a cap 275 connected by threaded attachment to the outlet sleeve 270. The cap 275 has an upper end which offers a leading edge 240 facing in an uphole direction, against the fluid flow F. The outer wall of the cap 275 is cylindrical with parallel sides to match the inner bore 250*b*, but the inner wall 275*w* of the cap has a shaped profile which tapers radially inwards into the bore of the cap 275 to a throat 275*t*, which is narrower than the upper end of the bore of the cap 275, but wider than the seat 220. The inner wall of the cap 275*w* therefore forms a funnel in the bore, which acts to reduce turbulence and drag within the flow of the fluid, and to smooth out any eddies that would otherwise have been created by the upper end of the outlet sleeve 270. The funnel provided by the inner wall 275 directs fluid into the bore 201*b*, with a diameter that is at least equal to the diameter of the bore 201*b*, but can optionally be less than the diameter of the bore 201*b*.

In another optional feature, the control sleeve 260 is optionally castellated at its downhole end. These castellations can be in the form of arches cut out of the sleeve material, but other shapes may be used. The castellations permit fluid flow through the arches to the annular space in between the control sleeve 260 and the valve housing 250, into the cavity where the spring 280 is retained. In this case, when the control sleeve 260 moves in a downhole direction, the spring is free to compress as fluid is forced out of the cavity through the castellations and into the bore 250*b*. Similarly, when the control sleeve 260 is travelling back in an uphole direction to its initial configuration, the spring 280 must extend, and fluid can flow through the castellations into the spring cavity to fill the vacuum that the extension creates. This feature reduces the risk of hydraulic lock of the control sleeve 260. The spring retainer 285 likewise has similar formations allowing fluid communication and preventing or alleviating risks of hydraulic locking of the moving parts of the assembly 201.

An operation using the above example will now be described. During wellbore operations, for example downhole drilling, fluid is normally pumped axially down the drill string to the drill bit for cooling the bit, and for washing cuttings back to the surface. The option of diverting the fluid being pumped down the bore of the string into a radial fluid flowpath can be desirable in order to e.g. clean drill cuttings from the annulus of the wellbore. In this example, the ball 210*a* is dropped from the surface and travels through the bore of the string under the combined force of gravity and fluid being pumped down the well by positive displacement pumps at the surface. The ball 210*a* enters the bore 250*b* of the valve assembly 201 and passes through the cap 275 of the outlet sleeve 270. The ball 210*a* then passes through the cap 267 of the control sleeve 260 and the landing sleeve 269, and into the narrower bore, passing the control sleeve aperture 262 before landing on the seat 220. When engaged with the seat 220, the non-deformable ball 210*a* forces deformation of the resilient first (upper) seat member 221 under the initial force of fluid pressure in the bore behind the ball 210*a*. As the ball 210*a* passes through throat of the seat member 221, the seat member 221 is radially compressed by the ball 210*a*, such that its radial thickness is reduced and the diameter of the bore increases in a transient and reversible manner, but while the outer diameter of the seat member 221 and the volume remain unchanged. The second resilient seat member 222, being in this example larger than seat member 221, requires more force to deform and allow passage of the ball 210*a*. The ball 210*a* is thus held within a cleft in the seat 220, below the first seat member 221 and above the second seat member 222, and is retained there under the opposing axial urging forces that the seat members 221, 222 apply to the ball's uphole- and downhole-facing surfaces.

The seating of the ball 210*a* in the seat 220 obturates the axial fluid flowpath $F_1$, as the seat members 221, 222 sealingly engage with at least a circumferentially-extending portion of the surface of the ball 210*a*. The resulting increase in fluid pressure uphole of the valve assembly 201 and into the bore 250*b* applies a correspondingly increasing force to the uphole-facing surface of the seated ball 210*a*. Once the fluid pressure has reached a threshold where the force applied to the ball 210*a* is greater than the opposing biasing force of the spring 280, the control sleeve 260 begins to travel axially in a downhole direction, and is guided in an axially-travelling path by the inner ends of the pins 254 occupying axial slots on the outer surface of the control sleeve 260. Any rotational movement of the control sleeve 260 at this point could lead to the aperture 262, through the wall of the control sleeve 260, being misaligned relative to the aperture 272, through the wall of the outlet sleeve 270, and the outlet port 252, through the side wall of the housing 250. Hence, preventing rotation via the pins 254 increases consistency of fluid flow through the open outlet port 252.

The spring 280 is compressed between the spring retainer 285 and the chamfered shoulder 261 in the control sleeve 260, with the compression increasing as the control sleeve 260 travels axially downwards. The control sleeve aperture 262 begins to cross the outlet aperture 272, allowing a small volume of fluid to be diverted out of the outlet port 252, which is fully aligned with the aperture 272. This diversion of fluid can sometimes slightly reduce the fluid pressure within the bore, and pumping from the surface can optionally increase accordingly in order to maintain sufficient force to continue compressing the spring 280. Once the control sleeve 260 has reached the full extent of its travel, the apertures 262, 272 and the outlet port 252 are fully aligned, and the flow of fluid is diverted along the radial flowpath shown as arrows $F_2$ in FIG. 13, through the apertures 262, 272, and outlet port 252, into the annulus of the well bore. Full alignment is not strictly necessary for satisfactory performance, but it is convenient to shift the control sleeve 260 by the same amount each time. The axial travel of the control sleeve 260 can optionally be limited by a travel stop formed by a shoulder on the outlet sleeve 270. As with the examples described above, sequential increases and decreases in the pressure drive the control sleeve 260 through the various different stages, while the ball 210*a* remains seated on the seat 220.

Once the function of the radial flow of fluid into the annulus has been performed, and the operator wishes to return the fluid flow to an axial direction through the valve assembly 201, a second ball 210*b* is dropped from the surface, and travels through the string to the valve assembly 201 under the combined force of gravity and fluid flow. The ball 210*b* passes through the narrowed bore of the cap 267 and lands on the uphole-facing surface of the first ball 210*a*, which remains retained in the seat 220. The second ball 210*b* can be of a smaller diameter than the first ball 210*a*. The second ball 210*b* either partially or wholly obturates the bore 201*b* at a position uphole of the aperture 262, optionally blocking the bore 269*b* of the landing sleeve 269 which is selected to deny any substantial fluid flow past the ball 210*b* when it is in the landing sleeve 269.

In order to increase the force applied to the first ball 210*a*, the fluid pressure can be increased from the surface to a second pressure threshold which is optionally higher than the first threshold. This increases the force bearing down on the uphole-facing surface of the second ball 210*b*, which in turn bears down on the first ball 210*a*. The downhole-directed force applied by the higher second pressure threshold drives the non-deformable ball 210*a* down the bore 201*b* to begin deformation of the second valve seat member 222 and press into the narrow throat of the seat member 222. The ball 210*a* causes the seat member 222 to compress in a radially outward direction, transiently increasing the diameter of the bore formed by the seat member (while optionally maintaining outer diameter and volume), and allowing the ball 10*a* to pass through the seat 220. The second ball, 210*b*, is in this example of a smaller diameter than the first ball 210*a*, and so it passes comparatively easily through the seat 220 without seating. The balls 210*a*, 210*b*, are then optionally caught in a ball catcher downhole of the valve assembly (not shown). The second seat member 222 meanwhile returns to its initial uncompressed configuration.

Once the balls 210*a*, 210*b* have passed through the valve seat 220, the fluid pressure is relieved, and there is nothing to maintain the compression of the spring 280 which returns the control sleeve 260 to its original upper position. As the control sleeve 260 moves in an uphole direction, the wiper 267*w* wipes against the inner surface of the outlet sleeve 270 and cleans away debris, reducing the risk of the control sleeve 260 jamming and maintaining the smooth running of the control sleeve within the outlet sleeve 270, and keeping any debris from entering the annulus between the control sleeve 260 and the outlet sleeve 270, and degrading the seals therein. Once the control sleeve 260 has returned to its initial position, the aperture 262 is wholly out of alignment with the aperture 272 and the outlet port 252 and the fluid flow returns to an axial path, shown as arrow $F_1$ in FIG. 12.

By varying the dimensions of the balls 210*a*, 210*b* and the seat 220, it is possible to partially close the bore 201*b*, and merely restrict fluid passage through the valve assembly. This moves the control sleeve 260 into an intermediate position (not shown) where the aperture 262 is partly aligned with the aperture 272 and outlet port 252. This can be used to increase the pressure of the radial jets of fluid through the port 252, for example.

Figure 17:
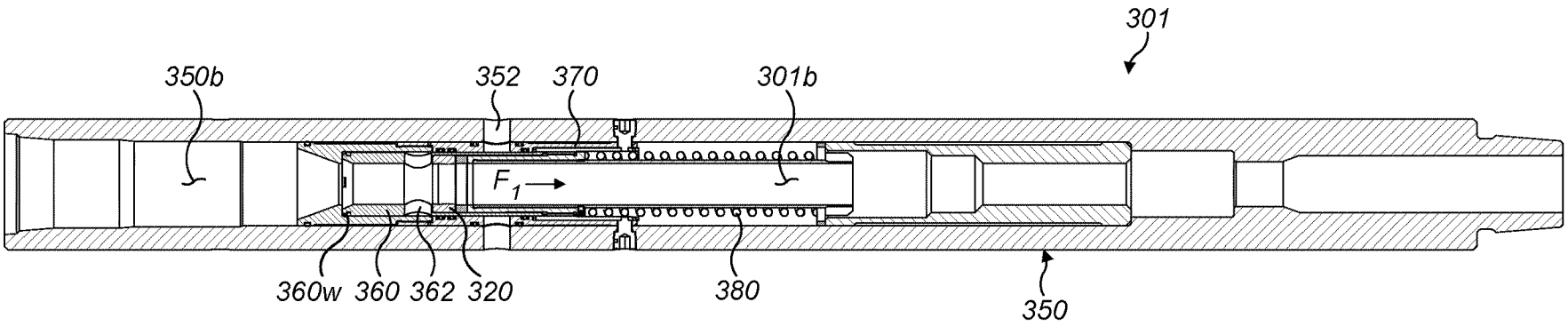
FIGS. 17-19 show views of a second example of a valve assembly similar to FIGS. 12-14.
Figure 18:
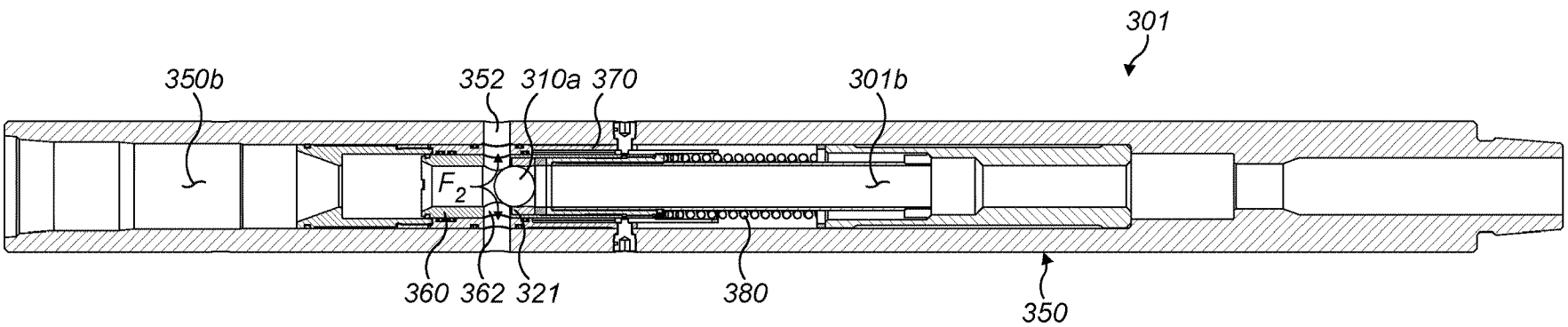
Figure 19:
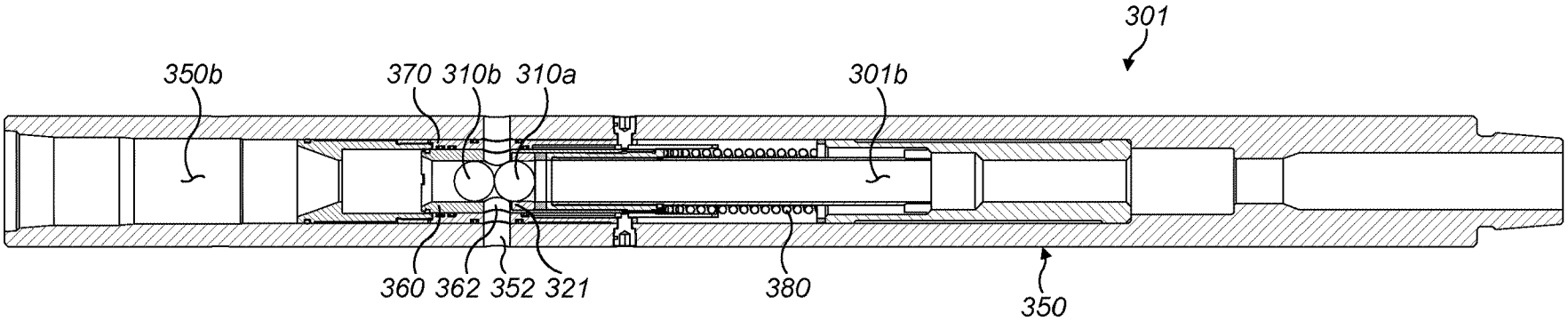

FIGS. 17-19 show a further alternative example of the apparatus, with the parts of the apparatus that correspond to the same parts in the third aspect being denoted by the same reference numbers increased by 100. The features of this example can be combined with the other examples disclosed herein. A valve assembly 301, for use in a wellbore of an oil, gas or water well, comprises a housing 350 having a bore 350*b* in fluid communication with the bore of the string of tubulars in which the valve assembly is integrated. The bore 350*b* houses an outlet sleeve 370 and a control sleeve 360. The outlet sleeve 370 at least partly surrounds a portion of a control sleeve 360, which has a bore 301*b* with an axis that is generally co-axial with the bore 350*b* of the housing and the bore of the outlet sleeve 370. The bores of the sleeves 360, 370 are in fluid communication with the bore 350*b* of the housing 350.

The valve assembly 301 operates in substantially the same way as the valve assembly 201 described above, and thus the similar components and method of operation are not described again here, for brevity, and the reader is directed to the description of valve assembly 201 above.

The uphole end of the control sleeve 360 is formed as a single component, with a chamfered uphole-facing edge narrowing into the bore 301*b*, which optionally has a consistent inner diameter along its length. On the outer surface of the control sleeve 360 is wiper 360*w*, which acts to wipe or scrape the inner surface of the outlet sleeve 370 as the control sleeve 360 returns from a position where the outlet port 352 is open, to the control sleeve's original position where the outlet port 352 is closed. The ball 310*a* is dropped from the surface landing on the seat 320, and forces deformation of the resilient first (upper) seat member 321 so that it is held within a cleft in the seat 320 as described above. This obturates the axial fluid flowpath $F_1$, and shifts the control sleeve 360 to open the radial outlet port 352 and compress the spring 380. As with the examples described above, sequential increases and decreases in the pressure drive the control sleeve 360 through the various different stages, while the ball 310*a* remains seated on the seat 320. The second ball 310*b* is dropped from the surface, and lands on the first ball 310*a*, retained in the seat 320. The second ball 310*b* can be of a smaller diameter than the first ball 310*a*. The second ball 310*b* either partially or wholly obturates the bore at a position uphole of the aperture 362, but the present example has no landing sleeve, and hence does not allow for the same variation in diameters of balls 310*b*. The force applied by the higher second pressure threshold drives balls 310*a*, 310*b* through the seat 320 as previously described, allowing the return of the control sleeve 360 to the first configuration under the force of the spring 380.

The invention claimed is:

1. A valve assembly for use in a wellbore of an oil, gas or water well, the valve assembly comprising:

a bore with an axis;

a valve seat adapted to seat a valve closure member, the valve seat comprising a first seat member adapted to seat the valve closure member in a first configuration, wherein the first seat member is adapted to resiliently deform from the first configuration to a second configuration to allow passage of the valve closure member past the first seat member at a first threshold pressure, and a second seat member adapted to seat the valve closure member in a first configuration, wherein the second seat member is adapted to resiliently deform from the first configuration to a second configuration to allow passage of the valve closure member past the second seat member at a second threshold pressure; and an outlet port and a control sleeve adapted to cycle the valve assembly between a first configuration of the valve assembly and a second configuration of the valve assembly, wherein in the first configuration of the valve assembly, the control sleeve is configured to obturate the outlet port and to restrict fluid communication between the bore and the outlet port, wherein in the second configuration of the valve assembly, the control sleeve is configured to allow at least partial fluid communication between the bore and the outlet port, and wherein the valve assembly is repeatedly cyclable between the first and second configurations of the valve assembly, while the valve closure member is seated on the valve seat, by changes in fluid pressure acting on the seated valve closure member.

2. The valve assembly as claimed in claim 1, wherein the valve assembly is biased into the first configuration of the valve assembly and is adapted to be switched into the second configuration of the valve assembly by the application of fluid pressure on the seated valve closure member.

3. The valve assembly as claimed in claim 1, wherein the valve assembly is adapted to be cycled sequentially and continuously between the first and second configurations of the valve assembly while the valve closure member is seated on the valve seat by sequential changes in fluid pressure acting on the seated valve closure member.

4. The valve assembly as claimed in claim 1, wherein fluid pressure acting on the seated valve closure member at the first threshold pressure overcomes the force of a spring biasing the control sleeve axially within the bore, and wherein the control sleeve is urged axially under the first threshold pressure relative to the outlet port as the valve assembly moves from the first configuration to the second configuration.

5. The valve assembly as claimed in claim 4, wherein at the first threshold pressure, the valve seat remains in the first configuration and continues to engage the valve closure member such that the valve closure member is retained in the valve seat and continues to obturate the bore of the valve assembly.

6. The valve assembly as claimed in claim 4, wherein the valve seat is adapted to release the valve closure member in response to fluid pressure acting on the seated valve closure member at the second threshold pressure being higher than the first threshold pressure.

7. The valve assembly as claimed in claim 1, wherein:

the valve seat is adapted to be sealed by the valve closure member;

the second threshold pressure is higher than the first threshold pressure;

the first and second seat members are axially spaced from one another on the valve seat; and the valve seat is adapted to retain the valve closure member between the first and second seat members.

8. A valve assembly for use in a wellbore of an oil, gas or water well, the valve assembly comprising:

a bore with an axis; and a valve seat adapted to be sealed by at least one valve closure member, wherein the valve seat comprises a first seat member adapted to seat the at least one valve closure member in a first configuration of the first seat member, wherein the first seat member is adapted to resiliently deform from the first configuration to a second configuration of the first seat member to allow passage of the at least one valve closure member past the first seat member at a first threshold pressure, and a second seat member adapted to seat the at least one valve closure member in a first configuration of the second seat member, wherein the second seat member is adapted to resiliently deform from the first configuration of the second seat member to a second configuration of the second seat member to allow passage of the at least one valve closure member past the second seat member at a second threshold pressure, wherein said second threshold pressure is higher than the first threshold pressure, wherein the first and second seat members are axially spaced from one another on the valve seat by a cleft, and wherein the valve seat is adapted to retain the at least one valve closure member in the cleft between the first and second seat members.

9. The valve assembly as claimed in claim 8, wherein the first and second seat members are adapted to deform resiliently away from one another in opposite axial directions when the at least one valve closure member is retained between them, and wherein the first and second seat members are adapted to press on the at least one valve closure member from opposite axial directions to resist movement of the at least one valve closure member relative to the valve seat when said at least one valve closure member is retained between the first and second seat members.

10. The valve assembly as claimed in claim 8, wherein the resilience of the first and second seat members is adapted to maintain sealing engagement of the at least one valve closure member against the valve seat when the at least one valve closure member is retained between the first and second seat members.

11. The valve assembly as claimed in claim 8, wherein an inner radial dimension of each of the first and second seat members in the first configuration is smaller than the maximal radial dimension of the at least one valve closure member.

12. The valve assembly as claimed in claim 8, wherein each of the first and second seat members form mutually parallel rings having a hemispherical cross-sectional profile and extending circumferentially around an inner surface of a control sleeve of the valve assembly.

13. The valve assembly as claimed in claim 8, wherein each of the first and second seat members has an upper surface and a lower surface, wherein the upper and lower surfaces of the first and second seat members extend from an inner surface of the valve seat along an arcuate profile having a radius, and wherein each of the first and second seat members has an apex.

14. The valve assembly as claimed in claim 8, wherein an inner diameter of one of the first and second seat members is less than the inner diameter of the other seat member.

15. The valve assembly as claimed in claim 8, wherein the first and second seat members are spaced apart by an axial distance which is less than a maximal dimension of the at least one valve closure member.

16. The valve assembly as claimed in claim 8, wherein the cleft has a wider inner diameter than the first and second seat members.

17. The valve assembly as claimed in claim 8, further comprising an indexing mechanism adapted to control a change of configuration between the first and second configurations, the indexing mechanism comprising a track and pin arrangement which controls a movement of a control sleeve of the valve assembly.

18. The valve assembly as claimed in claim 17, wherein in the first configuration the pin is in one axial end of a track, and the outlet port is in fluid communication with the bore, and wherein in the second configuration, the pin is in the other axial end of the track, and the outlet port is not in fluid communication with the bore.

19. The valve assembly as claimed in claim 8, wherein sequential cycles of increase and decrease in fluid pressure acting on the seated at least one valve closure member cause an indexing mechanism to cycle the valve assembly continuously between first and second configurations.

20. The valve assembly as claimed in claim 8, wherein the valve assembly is adapted to move into at least one intermediate configuration between the second and the first configurations.

* * * * *